US009328575B2

(12) United States Patent
Feasey et al.

(10) Patent No.: US 9,328,575 B2
(45) Date of Patent: May 3, 2016

(54) DUAL GRADIENT MANAGED PRESSURE DRILLING

(71) Applicant: Weatherford Technology Holdings, LLC, Houston, TX (US)

(72) Inventors: Guy F. Feasey, Houston, TX (US); David Pavel, Kingwood, TX (US); Mark A. Mitchell, Pearland, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 515 days.

(21) Appl. No.: 13/752,804

(22) Filed: Jan. 29, 2013

(65) Prior Publication Data

US 2013/0192841 A1 Aug. 1, 2013

Related U.S. Application Data

(60) Provisional application No. 61/593,018, filed on Jan. 31, 2012.

(51) Int. Cl.
*E21B 7/12* (2006.01)
*E21B 21/08* (2006.01)
*E21B 21/00* (2006.01)

(52) U.S. Cl.
CPC . *E21B 21/08* (2013.01); *E21B 7/12* (2013.01); *E21B 21/001* (2013.01)

(58) Field of Classification Search
CPC ..... E21B 7/12; E21B 7/128; E21B 21/001; E21B 21/08
USPC ..... 166/336, 358; 175/5, 7, 40, 48, 207
See application file for complete search history.

(56) References Cited

U.S. PATENT DOCUMENTS 3,603,409 A * 9/1971 Watkins ..... 175/7
3,721,292 A 3/1973 Ahlstone
4,059,148 A 11/1977 Blomsma
(Continued)

FOREIGN PATENT DOCUMENTS

WO 00/75477 A1 12/2000
WO 01/94740 A1 12/2001
(Continued)

OTHER PUBLICATIONS

Atkinson, Ian, et al.—A New Horizon in Multiphase Flow Measurement, Oilfield Review. Winter 2004/2005, pp. 52-63.
(Continued)

*Primary Examiner* — Matthew R Buck
(74) *Attorney, Agent, or Firm* — Patterson & Sheridan, LLP

(57) ABSTRACT

A method of drilling a subsea wellbore includes drilling the wellbore by injecting drilling fluid through a tubular string extending into the wellbore from an offshore drilling unit (ODU) and rotating a drill bit disposed on a bottom of the tubular string. The method further includes, while drilling the wellbore: mixing lifting fluid with drilling returns at a flow rate proportionate to a flow rate of the drilling fluid, thereby forming a return mixture. The lifting fluid has a density substantially less than a density of the drilling fluid. The return mixture has a density substantially less than the drilling fluid density. The method further includes, while drilling the wellbore: measuring a flow rate of the returns or the return mixture; and comparing the measured flow rate to the drilling fluid flow rate to ensure control of a formation being drilled.

26 Claims, 15 Drawing Sheets

(56) References Cited

U.S. PATENT DOCUMENTS

| | | | | |
|---|---|---|---|---|
| 4,437,688 | A | 3/1984 | Kramer et al. | |
| 5,168,932 | A * | 12/1992 | Worrall et al. | 166/336 |
| 6,230,824 | B1 | 5/2001 | Peterman et al. | |
| 6,273,193 | B1 | 8/2001 | Hermann et al. | |
| 6,530,437 | B2 * | 3/2003 | Maurer et al. | 175/5 |
| 6,536,540 | B2 | 3/2003 | de Boer | |
| 6,668,943 | B1 * | 12/2003 | Maus et al. | 175/5 |
| 6,745,857 | B2 * | 6/2004 | Gjedebo | 175/69 |
| 6,802,379 | B2 * | 10/2004 | Dawson et al. | 175/38 |
| 6,843,331 | B2 | 1/2005 | de Boer | |
| 6,913,092 | B2 | 7/2005 | Bourgoyne et al. | |
| 6,926,101 | B2 | 8/2005 | deBoer | |
| 6,966,392 | B2 | 11/2005 | deBoer | |
| 7,090,036 | B2 | 8/2006 | deBoer | |
| 7,093,662 | B2 | 8/2006 | deBoer | |
| 7,350,597 | B2 * | 4/2008 | Reitsma et al. | 175/66 |
| 7,367,411 | B2 * | 5/2008 | Leuchtenberg | 175/48 |
| 7,584,801 | B2 | 9/2009 | deBoer | |
| 7,992,654 | B2 | 8/2011 | deBoer | |
| 8,033,335 | B2 * | 10/2011 | Orbell et al. | 166/367 |
| 8,066,079 | B2 | 11/2011 | de Boer | |
| 8,176,985 | B2 * | 5/2012 | Humphreys | 166/358 |
| 8,322,460 | B2 * | 12/2012 | Horton et al. | 175/5 |
| 8,403,059 | B2 * | 3/2013 | Hughes et al. | 166/367 |
| 8,490,719 | B2 * | 7/2013 | Duhe et al. | 175/57 |
| 8,757,272 | B2 * | 6/2014 | Couturier et al. | 166/373 |
| 2004/0065440 | A1 * | 4/2004 | Farabee et al. | 166/358 |
| 2004/0084213 | A1 * | 5/2004 | DeBoer | 175/5 |
| 2006/0157282 | A1 | 7/2006 | Tilton et al. | |
| 2011/0108282 | A1 * | 5/2011 | Kozicz et al. | 166/367 |
| 2011/0168410 | A1 | 7/2011 | deBoer | |
| 2012/0037361 | A1 * | 2/2012 | Santos | E21B 21/08 166/250.08 |
| 2012/0234550 | A1 * | 9/2012 | Dietz | E21B 21/08 166/344 |

FOREIGN PATENT DOCUMENTS

| | | | |
|---|---|---|---|
| WO | 02/50398 | A1 | 6/2002 |
| WO | 2004/033845 | A2 | 4/2004 |
| WO | 2011058031 | A2 | 5/2011 |
| WO | 2012035001 | A2 | 3/2012 |

OTHER PUBLICATIONS

PCT International Search Report and Written Opinion, dated Mar. 20, 2014, for International Application No. PCT/US2013/023916.

* cited by examiner 220
22
60d
10p
23
24
247b
270
247a
243
46
27
60b
25
201, 201t
60b
25
60d
201p
42a
41u
42u
41b
42b
40
50
2f
76
70
60m
POD
28
260
47c
45c
47d
45d
60r

DUAL GRADIENT MANAGED PRESSURE DRILLING

BACKGROUND OF THE INVENTION

1. Field of the Invention

Embodiments of the present invention generally relate to dual gradient managed pressure drilling.

2. Description of the Related Art

In well construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Deep water off-shore drilling operations are typically carried out by a mobile offshore drilling unit (MODU), such as a drill ship or a semi-submersible, having the drilling rig aboard and often make use of a marine riser extending between the wellhead of the well that is being drilled in a subsea formation and the MODU. The marine riser is a tubular string made up of a plurality of tubular sections that are connected in end-to-end relationship. The riser allows return of the drilling mud with drill cuttings from the hole that is being drilled. Also, the marine riser is adapted for being used as a guide for lowering equipment (such as a drill string carrying a drill bit) into the hole.

SUMMARY OF THE INVENTION

Embodiments of the present invention generally relate to dual gradient managed pressure drilling. In one embodiment, a method of drilling a subsea wellbore includes drilling the wellbore by injecting drilling fluid through a tubular string extending into the wellbore from an offshore drilling unit (ODU) and rotating a drill bit disposed on a bottom of the tubular string. The drilling fluid exits the drill bit and carries cuttings from the drill bit. The drilling fluid and cuttings (returns) flow to a floor of the sea via an annulus defined by an outer surface of the tubular string and an inner surface of the wellbore. The method further includes, while drilling the wellbore: mixing lifting fluid with the returns at a flow rate proportionate to a flow rate of the drilling fluid, thereby forming a return mixture. The lifting fluid has a density substantially less than a density of the drilling fluid. The return mixture has a density substantially less than the drilling fluid density. The method further includes, while drilling the wellbore: measuring a flow rate of the returns or the return mixture; and comparing the measured flow rate to the drilling fluid flow rate to ensure control of a formation being drilled.

In another embodiment, a method of drilling a subsea wellbore includes: drilling the wellbore by injecting drilling fluid through a tubular string extending into the wellbore from an offshore drilling unit (ODU) and rotating a drill bit disposed on a bottom of the tubular string. The drilling fluid exits the drill bit and carries cuttings from the drill bit. The drilling fluid and cuttings (returns) flow to a floor of the sea via an annulus defined by an outer surface of the tubular string and an inner surface of the wellbore. The returns flow from the seafloor to a subsea pressure control assembly (PCA) via a subsea wellhead. The subsea PCA comprises a mass flow meter. The method further includes, while drilling the wellbore: measuring a flow rate of the returns using the mass flow meter; and comparing the measured flow rate to the drilling fluid flow rate to ensure control of a formation being drilled.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
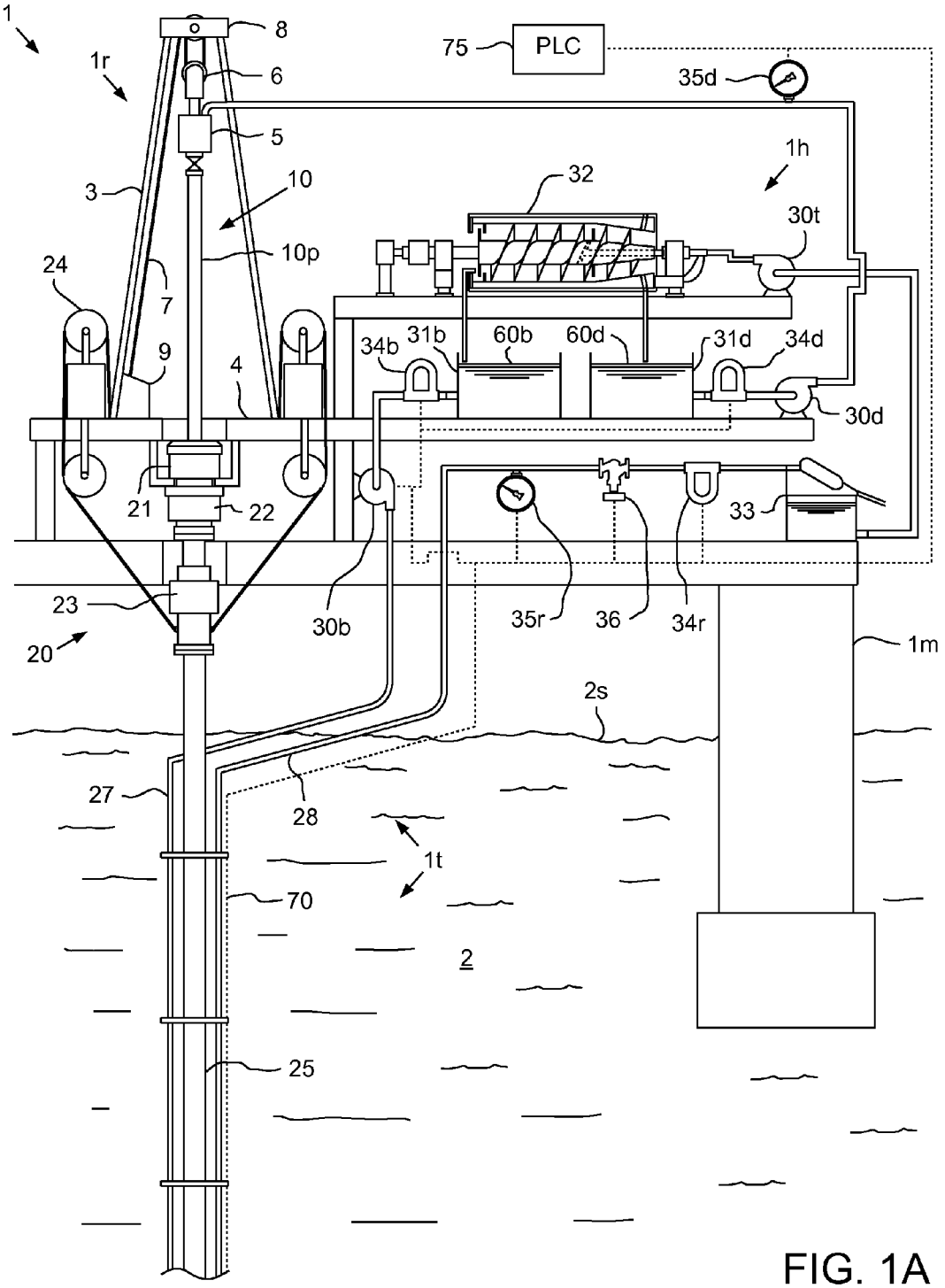
FIGS. 1A-1C illustrate an offshore drilling system, according to one embodiment of the present invention.
Figure 1B:
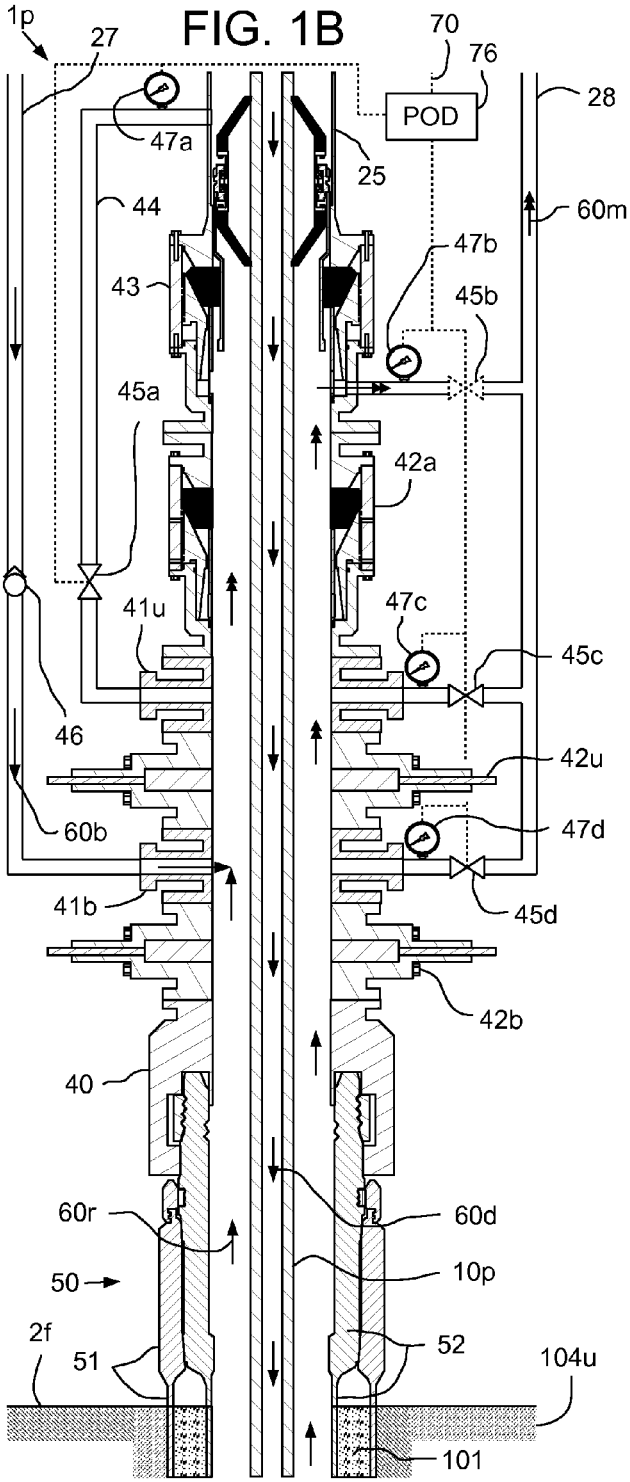
Figure 1C:
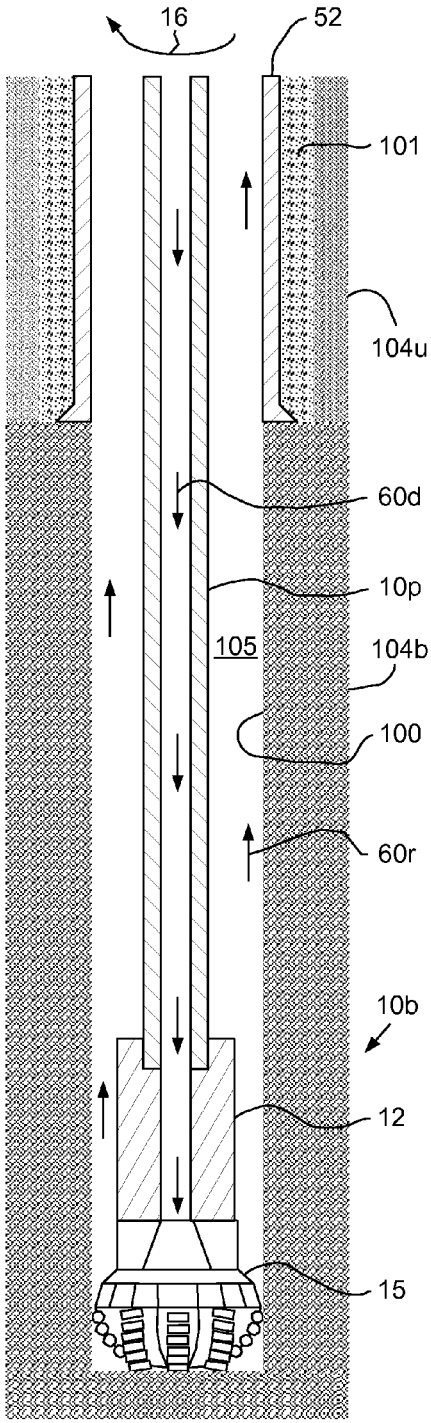

FIGS. 1A-1C illustrate an offshore drilling system 1, according to one embodiment of the present invention. The drilling system 1 may include a MODU 1*m*, such as a semi-submersible, a drilling rig 1*r*, a fluid handling system 1*h*, a fluid transport system 1*t*, and a pressure control assembly (PCA) 1*p*. The MODU 1*m* may carry the drilling rig 1*r* and the fluid handling system 1*h* aboard and may include a moon pool, through which drilling operations are conducted. The semi-submersible may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) and/or be moored for maintaining the moon pool in position over a subsea wellhead 50.

Alternatively, the MODU 1*m* may be a drill ship. Alternatively, a fixed offshore drilling unit or a non-mobile floating offshore drilling unit may be used instead of the MODU 1*m*. Alternatively, the wellhead may be located adjacent to the waterline 2*s* and the drilling rig 1*r* may be a located on a platform adjacent to the wellhead. Alternatively, a Kelly and rotary table (not shown) may be used instead of the top drive. Alternatively, the drilling system may be used for drilling a subterranean (aka land based) wellbore and the MODU may be omitted.

The drilling rig 1*r* may include a derrick 3 having a rig floor 4 at its lower end having an opening corresponding to the moonpool. The drilling rig 1*r* may further include a top drive 5. The top drive 5 may include a motor for rotating 16 a drill string 10. The top drive motor may be electric or hydraulic. A housing of the top drive 5 may be coupled to a rail (not shown) of the rig 1*r* for preventing rotation of the top drive housing during rotation of the drill string 10 and allowing for vertical movement of the top drive with a traveling block 6. A housing of the top drive 5 may be suspended from the derrick 3 by the traveling block 6. The traveling block 6 may be supported by wire rope 7 connected at its upper end to a crown block 8. The wire rope 7 may be woven through sheaves of the blocks 6, 8 and extend to drawworks 9 for reeling thereof, thereby raising or lowering the traveling block 6 relative to the derrick 3. A Kelly valve may be connected to a quill of a top drive 5. A top of the drill string 10 may be connected to the Kelly valve, such as by a threaded connection or by a gripper (not shown), such as a torque head or spear. The drilling rig 1*r* may further include a drill string compensator (not shown) to account for heave of the MODU 1*m*. The drill string compensator may be disposed between the traveling block 6 and the top drive 5 (aka hook mounted) or between the crown block 8 and the derrick 3 (aka top mounted).

The fluid transport system 1*t* may include the drill string 10, an upper marine riser package (UMRP) 20, a marine riser 25, and one or more auxiliary lines, such as a lift line 27 and a return line 28. The drill string 10 may include a bottomhole assembly (BHA) 10*b* and joints of drill pipe 10*p* connected together, such as by threaded couplings. The BHA 10*b* may be connected to the drill pipe 10*p*, such as by a threaded connection, and include a drill bit 15 and one or more drill collars 12 connected thereto, such as by a threaded connection. The drill bit 15 may be rotated 16 by the top drive 5 via the drill pipe 10*p* and/or the BHA 10*b* may further include a drilling motor (not shown) for rotating the drill bit. The BHA 10*b* may further include an instrumentation sub (not shown), such as a measurement while drilling (MWD) and/or a logging while drilling (LWD) sub.

The PCA 1*p* may be connected to a wellhead 50 located adjacent to a floor 2*f* of the sea 2. A conductor string 51 may be driven into the seafloor 2*f*. The conductor string 51 may include a housing and joints of conductor pipe connected together, such as by threaded connections. Once the conductor string 51 has been set, a subsea wellbore 100 may be drilled into the seafloor 2*f* and a casing string 52 may be deployed into the wellbore. The casing string 52 may include a wellhead housing and joints of casing connected together, such as by threaded connections. The wellhead housing may land in the conductor housing during deployment of a casing string 52. The casing string 52 may be cemented 101 into the wellbore 100. The casing string 52 may extend to a depth adjacent a bottom of an upper formation 104*u*. The upper formation 104*u* may be non-productive and a lower formation 104*b* may be a hydrocarbon-bearing reservoir. Alternatively, the lower formation 104*b* may be environmentally sensitive, such as an aquifer, or unstable. Although shown as vertical, the wellbore 100 may include a vertical portion and a deviated, such as horizontal, portion.

Figure 7B:
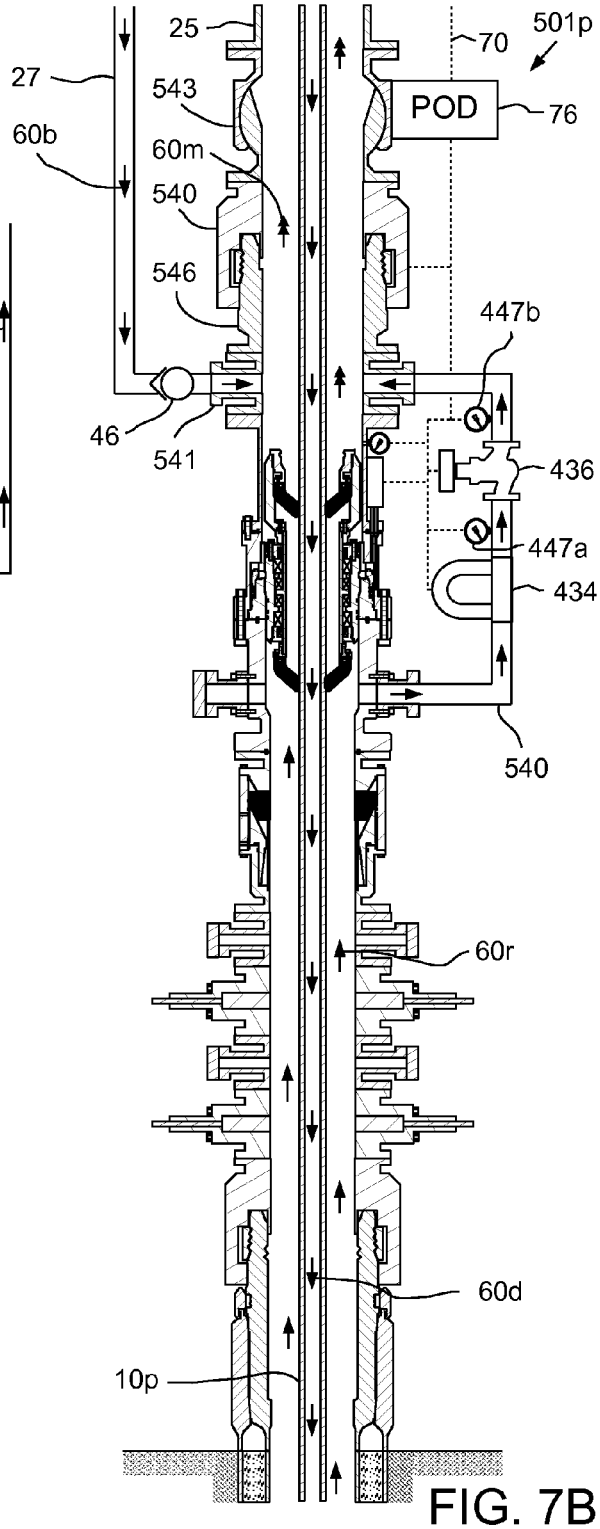
FIGS. 7A and 7B illustrate an offshore drilling system, according to another embodiment of the present invention.

The PCA 1*p* may include a wellhead adapter 40, one or more flow crosses 41*u,b*, one or more blow out preventers (BOPs) 42*a,u,b*, a subsea rotating control device (RCD) 43, a lower marine riser package (LMRP) (only control pod 76 shown), one or more accumulators (not shown), and a receiver (see receiver 546 of PCA 501*p* in FIG. 7B). The LMRP may include the control pod 76, a flex joint (see flex joint 543 of PCA 501*p* in FIG. 7B), and a connector (see connector 540 of PCA 501*p* in FIG. 7B). The wellhead adapter 40, flow crosses 41*u,b*, BOPs 42*a,u,b*, RCD 43, receiver, connector, and flex joint may each include a housing having a longitudinal bore therethrough and may each be connected, such as by flanges, such that a continuous bore is maintained therethrough. The bore may have drift diameter, corresponding to a drift diameter of the wellhead 50.

Each of the connector and wellhead adapter 40 may include one or more fasteners, such as dogs, for fastening the LMRP to the BOPS 42*a,u,b* and the PCA 1*p* to an external profile of the wellhead housing, respectively. Each of the connector and wellhead adapter 40 may further include a seal sleeve for engaging an internal profile of the respective receiver and wellhead housing. Each of the connector and wellhead adapter 40*b* may be in electric or hydraulic communication with the control pod 76 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 25 and connect the riser to the PCA 1*p*. The control pod 76 may be in electric, hydraulic, and/or optical communication with a programmable logic controller (PLC) 75 onboard the MODU 1*m* via an umbilical 70. The control pod 76 may include one or more control valves (not shown) in communication with the BOPs 42*a,u,b* for operation thereof. Each control valve may include an electric or hydraulic actuator in communication with the umbilical 70. The umbilical 70 may include one or more hydraulic or electric control conduit/cables for each actuator. The accumulators may store pressurized hydraulic fluid for operating the BOPs 42*a,u,b*. Additionally, the accumulators may be used for operating one or more of the other components of the PCA 1*p*. The umbilical 70 may further include hydraulic, electric, and/or optic control conduit/cables for operating various functions of the PCA 1*p*. The PLC 75 may operate the PCA 1*p* via the umbilical 70 and the control pod 76.

A lower end of a kill line 44 may be connected to a branch of the upper flow cross 41*u* and an upper end of the kill line may be connected to the riser 25 (shown), LMRP, or PCA above a lower portion of the RCD 43. Barrier fluid, such as kill mud or seawater, may be maintained in the riser 25 during the drilling operation. A shutoff valve 45*a* may be disposed in the kill line 44. A pressure sensor 47*a* may be connected to the kill line 44 between the shutoff valve 45*a* and the riser 25. The lift line 27 may be connected to an outlet of a lift pump 30*b* and to a branch of the lower cross 41*b*. A check valve 46 may be disposed in the lift line 27. The check valve 46 may be operable to allow fluid flow from the lift pump 30*b* to the lower flow cross 41*b* and prevent reverse flow from the lower flow cross 41*b* to the lift pump 30*b*. A lower end of the return line 28 may be connected to an outlet of the RCD 43. A shutoff valve 45*b* may be disposed in the return line 28. A pressure sensor 47*b* may be connected to the lift line 28 between the shutoff valve 45*b* and the RCD outlet.

An auxiliary manifold may also connect to the return line 28 and have a branch connected to a branch of each flow cross 41*u,b*. Shutoff valves 45*c,d* may be disposed in respective branches of the auxiliary manifold. Pressure sensors 47*c,d* may be connected to the auxiliary manifold branches between respective shutoff valves 45*c,d* and respective flow cross branches. Each pressure sensor 47*a-d* may be in data communication with the control pod 70. The lines 27, 28 and umbilical 70 may extend between the MODU 1*m* and the PCA 1*p* and may be fastened along the riser 25 and/or extend separately therefrom. Each line 27, 28, 44 may be a flow conduit. Each shutoff valve 45*a-d* may be automated and have a hydraulic actuator (not shown) operable by the control pod 76 via a respective umbilical conduit or the LMRP accumulators. Alternatively, the valve actuators may be electrical or pneumatic. The shutoff valves 45*a,c,d* may be normally closed and the shutoff valve 45*b* may be normally open (depicted in phantom) during the drilling operation.

The RCD 43 may include a housing, a piston, a packing, and a bearing assembly. The housing may be tubular and have one or more sections connected together, such as by flanged connections. The bearing assembly may include a bearing pack, one or more strippers, and a catch sleeve. The bearing assembly may be selectively longitudinally and torsionally connected to the housing by engagement of the packing with the catch sleeve. The housing may have hydraulic ports (not shown) in fluid communication (not shown) with the control pod 76 for selective operation of the piston by the control pod. The bearing pack may support the strippers from the catch sleeve such that the strippers may rotate relative to the housing (and the sleeve). The bearing pack may include one or more radial bearings, one or more thrust bearings, and a self contained lubricant system. The bearing pack may be disposed between the strippers and be housed in and connected to the catch sleeve, such as by a threaded connection and/or fasteners.

Each stripper may include a gland or retainer and a seal. Each stripper seal may be directional and the upper seal may be oriented to seal against the drill pipe 10*p* in response to higher pressure in the riser 25 than the wellbore 100 and the lower stripper seal may be oriented to seal against the drill pipe in response to higher pressure in the wellbore than the riser. Each stripper seal may have a conical shape for fluid pressure to act against a respective tapered surface thereof, thereby generating sealing pressure against the drill pipe 10*p*. Each stripper seal may have an inner diameter slightly less than a pipe diameter of the drill pipe 10*p* to form an interference fit therebetween. Each stripper seal may be flexible enough to accommodate and seal against threaded couplings of the drill pipe 10*p* having a larger tool joint diameter. The drill pipe 10*p* may be received through a bore of the bearing assembly so that the stripper seals may engage the drill pipe. The stripper seals may provide a desired barrier in the riser 25 either when the drill pipe 10*p* is stationary or rotating.

Figure 5:
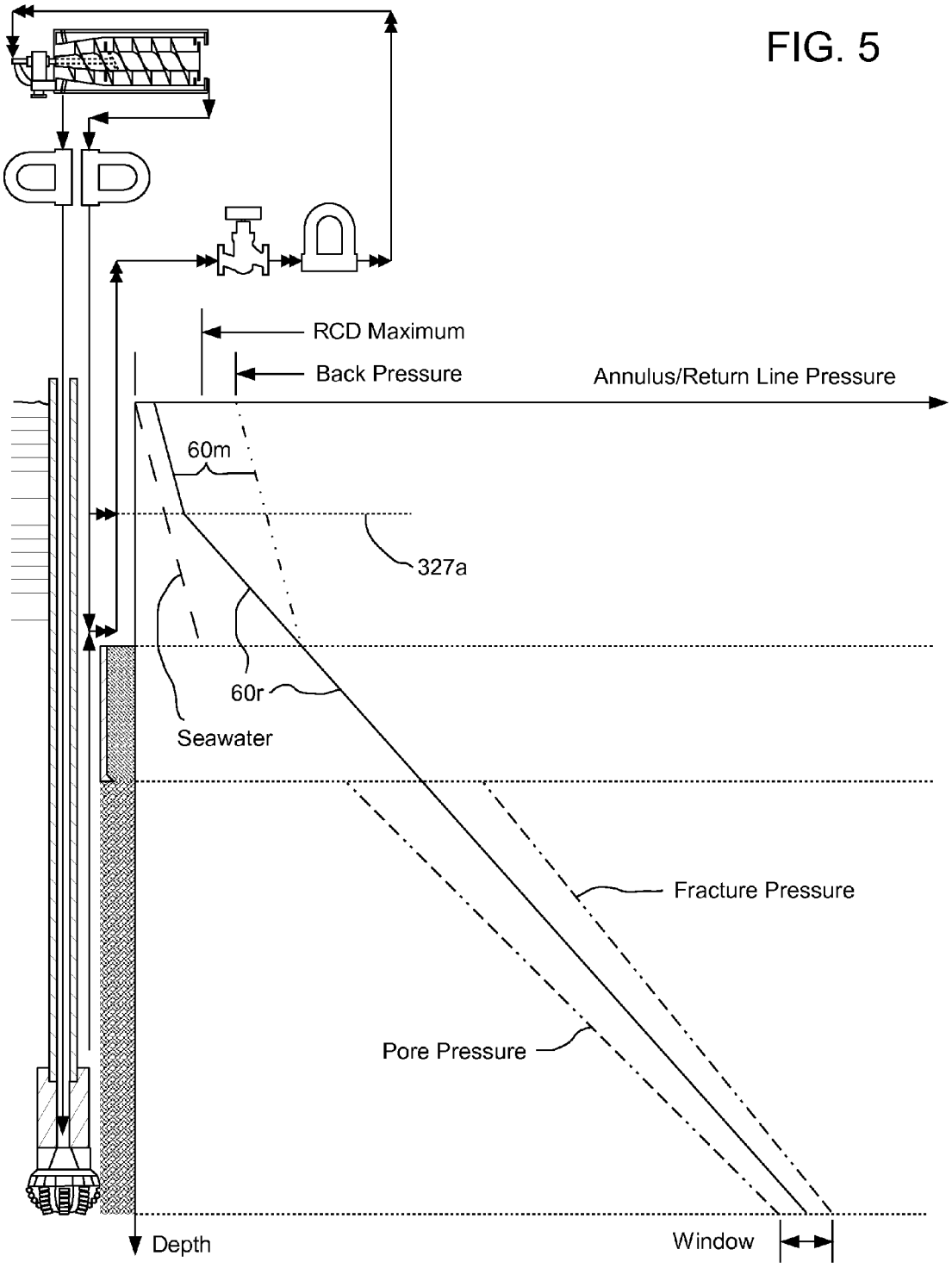
FIG. 5 illustrates selection of a location of an inner riser shoe of the concentric riser.

Alternatively, the RCD 243 (FIG. 3A) may be used instead of the RCD 43. Alternatively, an active seal RCD may be used and the bearing assembly may be non-releasably connected to the housing. Alternatively, the RCD 43 may be located in the UMRP 20 and the riser 25 used to conduct a return mixture 60*m* to the RCD. Additionally, for the UMRP RCD, the lift line 27 may be connected to the riser 25 at various points therealong for selective location of mixing (FIG. 5). Alternatively, the RCD 43 may be assembled as part of the riser 25 at any location therealong. Alternatively, both stripper seals may be oriented to seal against the drill pipe 10*p* in response to higher pressure in the wellbore 100 than the riser 25.

The riser 25 may extend from the PCA 1*p* to the MODU 1*m* and may be connected to the MODU via the UMRP 20. The UMRP 20 may include a diverter 21, a flex joint 22, a slip (aka telescopic) joint 23, and a tensioner 24. The slip joint 23 may include an outer barrel connected to an upper end of the riser 25, such as by a flanged connection, and an inner barrel connected to the flex joint 22, such as by a flanged connection. The outer barrel may also be connected to the tensioner 24, such as by a tensioner ring (not shown). The flex joint 22 may also connect to the diverter 21, such as by a flanged connection. The diverter 21 may also be connected to the rig floor 4, such as by a bracket.

The slip joint 23 may be operable to extend and retract in response to heave of the MODU 1*m* relative to the riser 25 while the tensioner 24 may reel wire rope in response to the heave, thereby supporting the riser 25 from the MODU 1*m* while accommodating the heave. The flex joints 23 may accommodate respective horizontal and/or rotational (aka pitch and roll) movement of the MODU 1*m* relative to the riser 25 and the riser relative to the PCA 1*p*. The riser 25 may have one or more buoyancy modules (not shown) disposed therealong to reduce load on the tensioner 24.

The fluid handling system 1*h* may include one or pumps 30*b,d,t*, one or more fluid tanks 31*b,d*, a fluid separator, such as a centrifuge 32, a solids separator, such as a shale shaker 33, one or more flow meters 34*b,d,r*, one or more pressure sensors 35*d,r*, and the variable choke valve 36. An upper end of the return line 28 may be connected to an inlet of the shaker 33. The pressure sensor 35*r*, choke 36, and flow meter 34*r* may be assembled as part of an upper portion of the return line 28. A transfer line may connect a fluid outlet of the shaker 33 to an inlet of a transfer pump 30*t*.

Each pressure sensor 35*d,r* may be in data communication with the PLC 75. The pressure sensor 35*r* may be connected to the return line 28 between the choke 36 and the shutoff valve 45*b* and may be operable to monitor backpressure exerted by the choke. The pressure sensor 35*d* may be connected to an outlet of the mud pump 30*d* and may be operable to monitor standpipe pressure. The choke 36 may be fortified to operate in an environment where the return mixture 60*m* may include solids, such as cuttings. The choke 36 may include a hydraulic actuator operated by the PLC 75 via a hydraulic power unit (HPU) (not shown) to maintain backpressure (FIG. 2A) in the wellhead 50. Alternatively, the choke actuator may be electrical or pneumatic.

Each flow meter 34*b,d,r* may be a mass flow meter, such as a Coriolis flow meter, and may be in data communication with the PLC 75. The flow meter 34*r* may be located downstream of the choke 36 and may be operable to monitor a flow rate of return mixture 60*m*. The flow meter 34*b* may be connected between the lift pump 30*b* and the lift tank 31*b* and may be operable to monitor a flow rate of the lift pump. The flow meter 34*d* may be connected between a mud pump 30*d* and the mud tank 31*d* and may be operable to monitor a flow rate of the mud pump.

Alternatively, the flow meters 34*b,d* may be volumetric instead of mass, such as a Venturi flow meter. Alternatively, a stroke counter (not shown) may be used to monitor a flow rate of each pump 30*b,d* instead of the respective flow meters 34*b,d*.

During the drilling operation, the mud pump 30*d* may pump drilling fluid 60*d* from the mud tank 31*d*, through the standpipe and a Kelly hose to the top drive 5. The drilling fluid

31*d* may include a base liquid. The base liquid may be base oil, water, brine, seawater, or a water/oil emulsion. The base oil may be diesel, kerosene, naphtha, mineral oil, or synthetic oil. The drilling fluid 60*d* may further include solids dissolved and/or suspended in the base liquid, such as organophilic clay, lignite, and/or asphalt, thereby forming a mud. The lifting fluid 60*b* may be the base liquid of the mud and thus have a density less or substantially less than the drilling fluid 60*d* due to the weighting effect of the added solids.

The drilling fluid 60*d* may flow from the standpipe and into the drill string 10 via the top drive 5. The drilling fluid 60*d* may be pumped down through the drill string 10 and exit the drill bit 15, where the fluid may circulate the cuttings away from the bit and return the cuttings up an annulus 105 formed between an inner surface of the casing 52 or wellbore 100 and an outer surface of the drill string 10. The returns 60*r* (drilling fluid 60*d* plus cuttings) may flow through the annulus 105 to the wellhead 50. The lift pump 30*b* may pump lifting fluid 60*b* from the lift tank 31*b*, through the lift line 27, and into the PCA 1*p* via a branch of the lower flow cross 41*b*.

In the PCA 1*p*, the lifting fluid 60*b* may mix with the returns 60*r* flowing from the wellhead 50, thereby forming the return mixture 60*m*. The return mixture 60*m* may be diverted by the RCD 43 into the RCD outlet. The return mixture 60*m* may then flow to the MODU 1*m* via the return line 28, through the choke 36 and flow meter 34*r*, and be processed by the shale shaker 33 to remove the cuttings. The return mixture 60*m* (minus cuttings) may be pumped flow from the shaker 33 to the centrifuge 32 by the transfer pump 30*t*. As the drilling fluid 60*d*, returns 60*r*, and return mixture 60*m* circulate, the drill string 10 may be rotated 16 by the top drive 5 and lowered by the traveling block 6, thereby extending the wellbore 100 into the lower formation 104*b*.

The centrifuge 32 may include a housing, a feed tube, a bowl, a conveyor, a bowl drive, a conveyor drive, a low density (aka light) fluid outlet, and a high density (aka heavy) fluid outlet. The bowl may be disposed in the housing and rotatable relative thereto. The bowl may have a tapered end with the heavy fluid outlet and a non-tapered end with the light fluid outlet. The bowl may have a weir for blocking flow of the heavy fluid through the light fluid outlet. The weir may be adjustable. The conveyor may be a helical (aka screw) conveyor for pushing the heavier density fluid to the tapered end of the bowl and out of the heavy fluid outlet. The conveyor may have a channel formed therein for transporting the return mixture 60*m* (minus cuttings removed by the shaker 33) from the feed tube into a chamber formed between the bowl and the conveyor. The conveyor may be rotated relative to the housing about a horizontal axis of rotation by the conveyor drive at a first speed and the bowl may be rotated relative to the housing along the same axis by the bowl drive at a second speed. The second speed may be greater than the first speed.

The return mixture 60*m* may enter the chamber of the centrifuge 32 via the feed tube and conveyor channel and be separated into layers of varying density by centrifugal forces such that the heavy fluid layer, such as drilling fluid 60*d*, is located radially outward relative to the horizontal axis and the light fluid layer, such as the lifting fluid 60*b*, is located radially inward relative to the heavy fluid layer. The weir may be set at a selected depth such that the drilling fluid 60*d* cannot pass over the weir and instead is pushed to the tapered end of the bowl and through the heavy fluid outlet by the rotating conveyor. The lifting fluid 60*b* may flow over the weir and through the light fluid outlet of the non-tapered end of the bowl. In this way, the return mixture 60*m* may be separated into its two (remaining) components: the drilling fluid 60*d* and the lifting fluid 60*b*. The drilling fluid 60*d* may be discharged from the heavy fluid outlet into mud tank 31*d* and the lifting fluid 60*b* may fluid may be discharged from the light fluid outlet into the lifting tank 31*b*.

Alternatively, the centrifuge may be omitted and the return mixture may be discharged into a waste tank instead of being recycled. Alternatively, the drill string may include casing instead of drill pipe and the casing may be left in the wellbore and cemented in place instead of removing the drill string to install a second casing string. Alternatively, the drill string 10 may include coiled tubing instead of drill pipe. Alternatively, the riser 25 may be omitted from the drilling system 1.

Figure 2A:
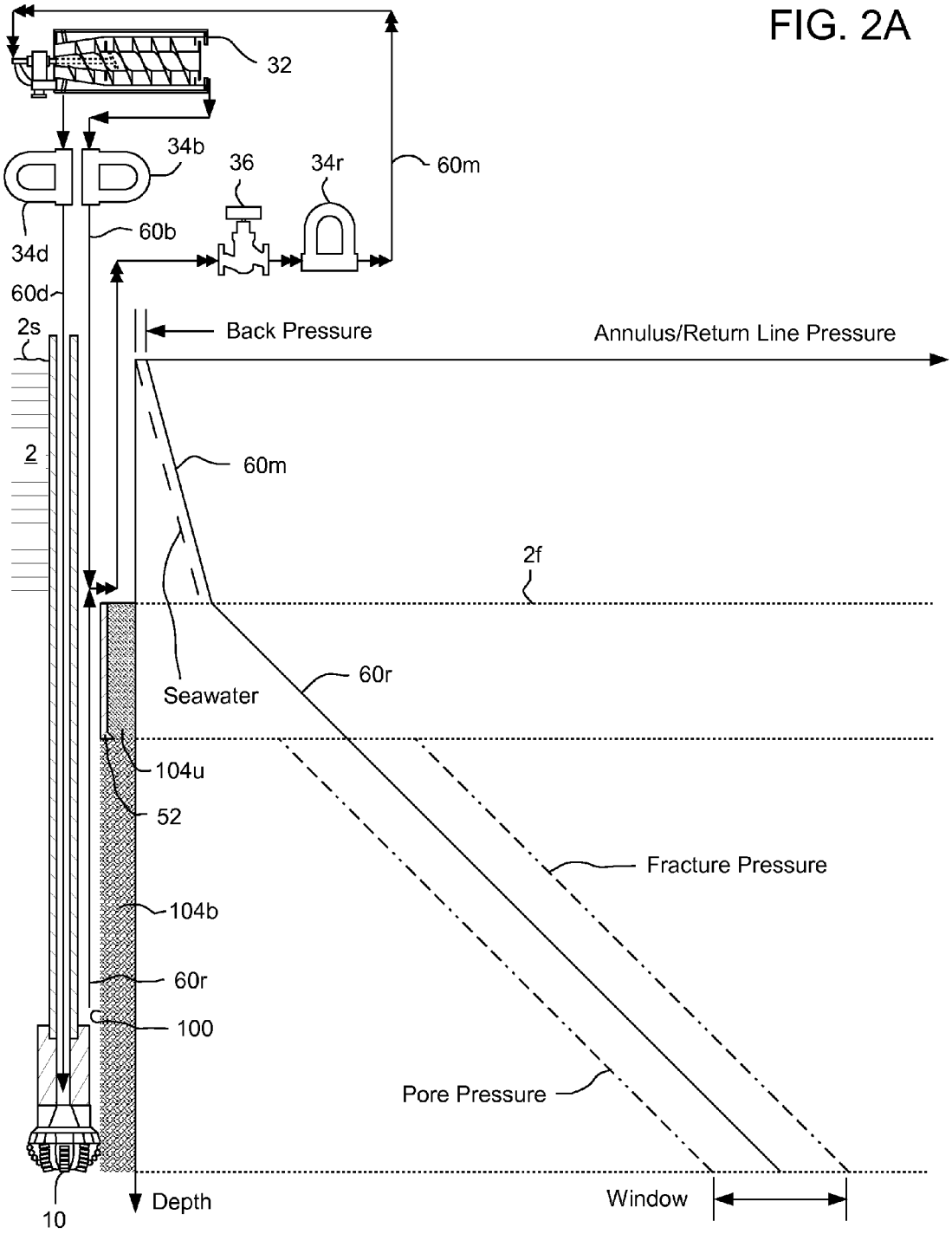
FIG. 2A illustrates operation of a programmable logic controller (PLC) of the drilling system during drilling of an ideal lower formation.
Figure 2B:
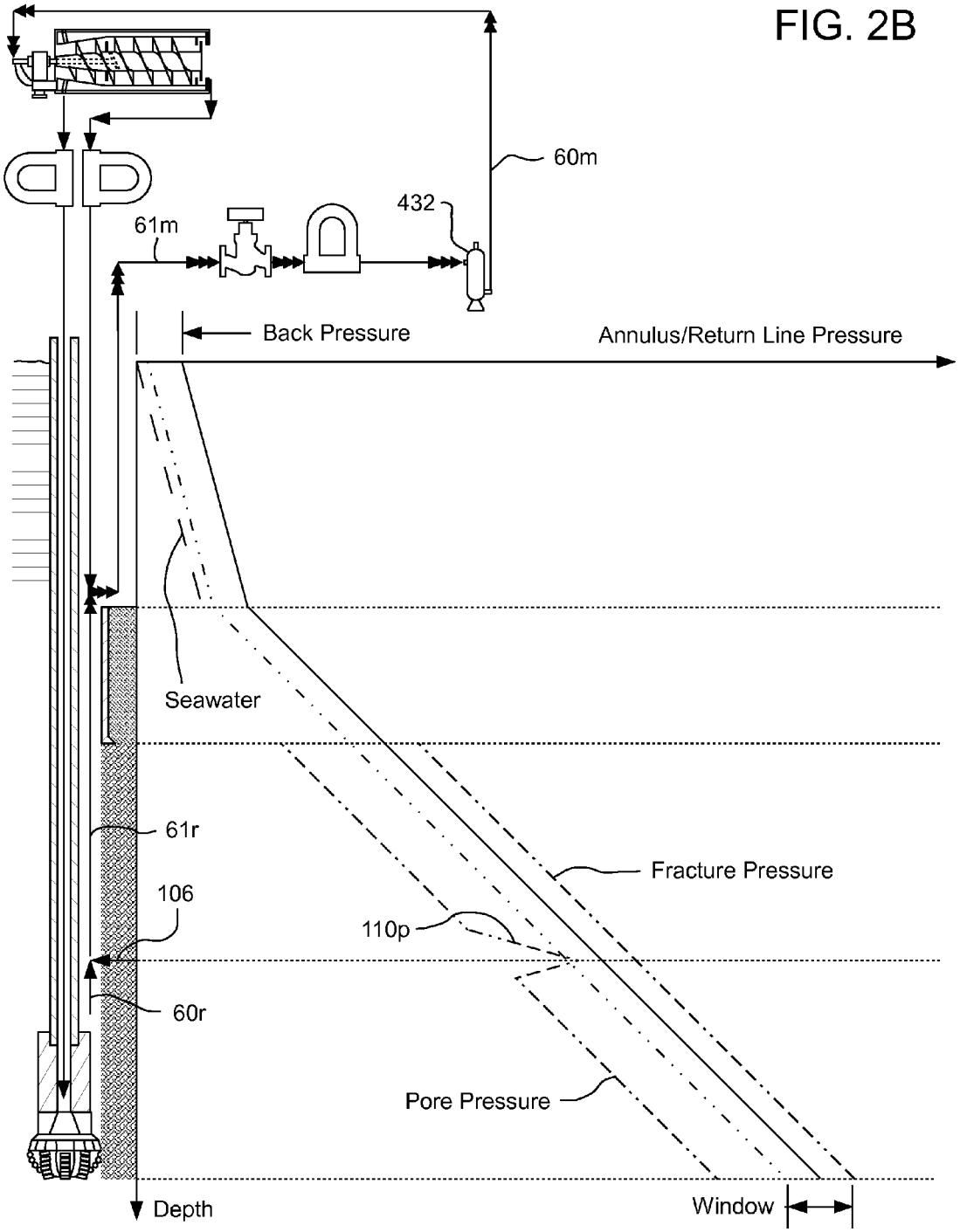
FIG. 2B illustrates operation of the PLC during drilling of a lower formation having an abnormally high pressure region.
Figure 2C:
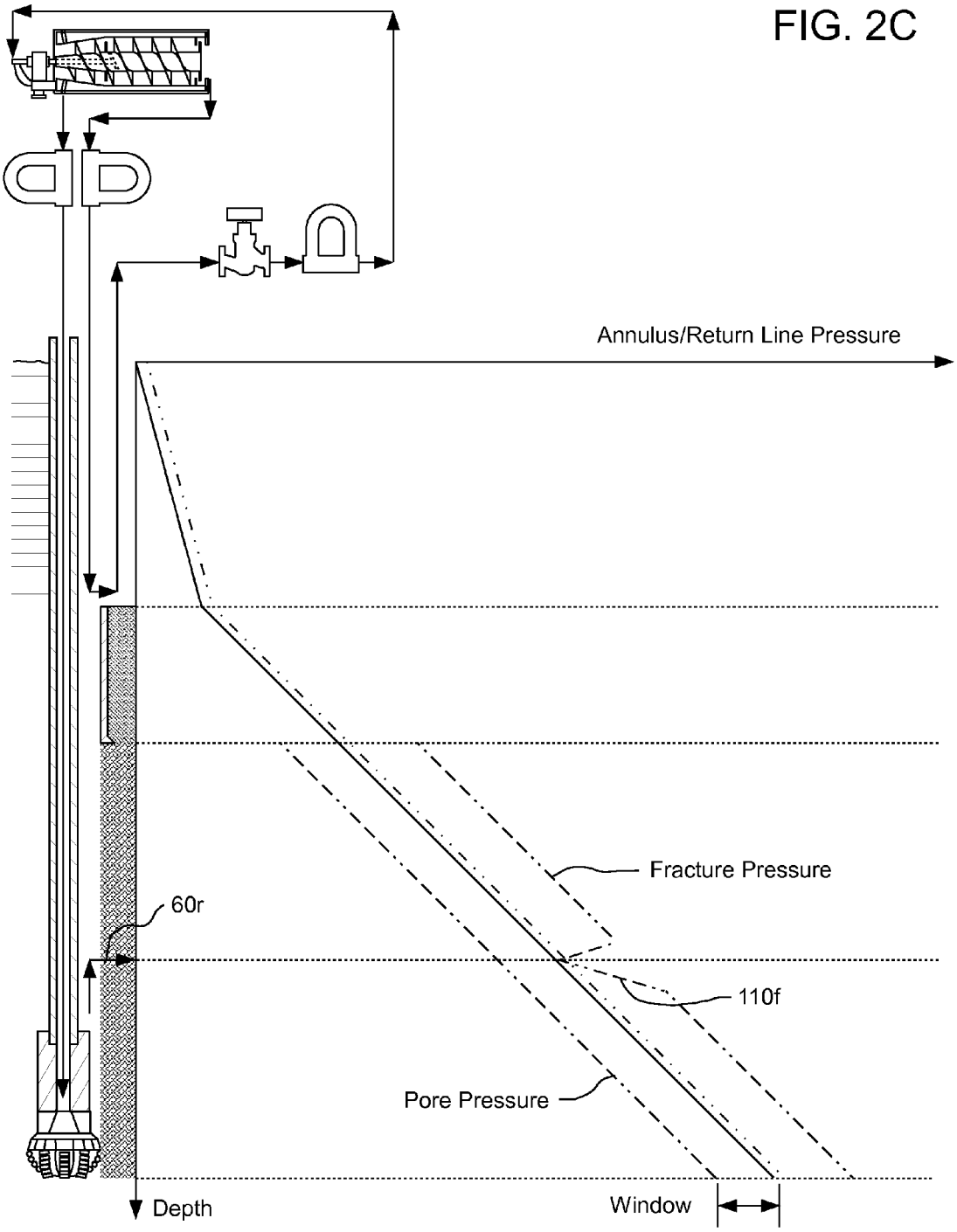
FIGS. 2C and 2D illustrate operation of the PLC during drilling of a lower formation having an abnormally low pressure region.
Figure 2D:
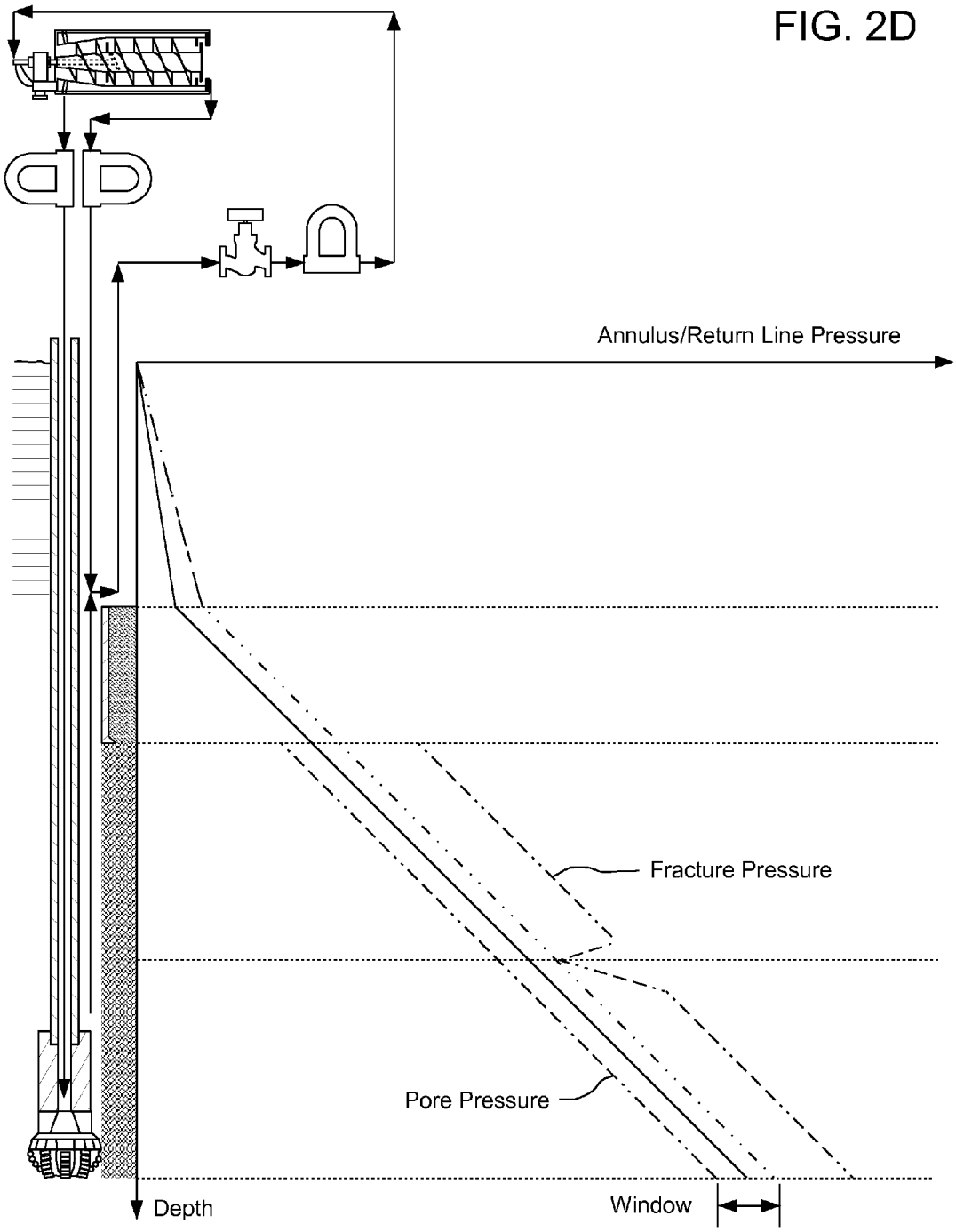

FIG. 2A illustrates operation of the PLC 75 during drilling of an ideal lower formation 104*b*. FIG. 2B illustrates operation of the PLC 75 during drilling of a lower formation 104*b* having an abnormally high pressure region 110*p*. FIGS. 2C and 2D illustrate operation of the PLC 75 during drilling of a lower formation 104*b* having an abnormally low pressure region 110*f*.

The PLC 75 may be programmed to operate the lift pump 30*b* and the choke 36 so that a target bottomhole pressure (BHP) is maintained in the annulus 105 during the drilling operation. The target BHP may be selected to be within a drilling window defined as greater than or equal to a minimum threshold pressure, such as pore pressure, of the lower formation 104*b* and less than or equal to a maximum threshold pressure, such as fracture pressure, of the lower formation. As shown, the target pressure is an average of the pore and fracture BHPs.

Alternatively, the minimum threshold may be stability pressure and/or the maximum threshold may be leakoff pressure. Alternatively, threshold pressure gradients may be used instead of pressures and the gradients may be at other depths along the lower formation 130*b* besides bottomhole, such as the depth of the maximum pore gradient and the depth of the minimum fracture gradient. Alternatively, the PLC may be free to vary the BHP within the window during the drilling operation.

Due to the dual gradient effect caused by a substantially lower density (slope of Seawater line) of the sea 2 relative to the pore and fracture pressure gradients (slopes of Pore Pressure and Fracture Pressure lines, respectively) of the lower formation 104*b*, a single gradient drilling fluid would be unable to stay within the drilling window.

A static density of the drilling fluid 60*d* (typically assumed equal to returns 60*r*; effect of cuttings typically assumed to be negligible) may correspond to a minimum threshold pressure gradient of the lower formation 104*b*, such as being greater than or equal to a pore pressure gradient. An equivalent circulation density (ECD) (static density plus dynamic friction drag) of the drilling fluid 60*d* may correspond to a maximum threshold pressure gradient of the lower formation 104*b*, such as fracture pressure gradient.

A static and/or ECD of the lifting fluid 60*b* may be less than, substantially less than, or equal to a density of seawater 2 (eight point five six pounds per gallon (PPG) or one thousand twenty-five kilograms per cubic meter ($kg/m^3$)). The lifting fluid 60*b* may compensate for the dual gradient effect by creating a corresponding dual gradient effect by reducing or substantially reducing the static density and/or ECD of the returns 60*r* to a static density and/or ECD of the return mixture 60*m*. The static and/or ECD of the return mixture 60*m* may correspond to the seawater density. The lifting fluid 60*b* may reduce the static density/ECD of the returns 60*r* by a lifting ratio (static density/ECD of return mixture 60*m* divided by static density/ECD of returns 60*r*) of less than one, such as one-half to three-fourths.

During the drilling operation, the PLC 75 may execute a real time simulation of the drilling operation in order to predict the actual BHP from measured data, such as standpipe pressure from sensor 35*d*, mud pump flow rate from flow meter 31*d*, lifting fluid flow rate from flow meter 34*b*, wellhead pressure from sensor 47*b*, and return fluid flow rate from flow meter 34*r*. The PLC 75 may then compare the predicted BHP to the target BHP and adjust the choke 36 accordingly.

During the drilling operation, the PLC 75 may also perform a mass balance to monitor for a kick or lost circulation. As the drilling fluid 60*d* is being pumped into the wellbore 100 by the mud pump 30*d*, the lifting fluid 60*b* is being pumped into the PCA 1*p* by the lifting pump 30*b*, and the return mixture 60*m* is being received from the return line 28, the PLC 75 may compare the mass flow rates (i.e., sum of drilling and lifting fluid flow rates minus return mixture flow rate) using the flow meters 34*b,d,r*. The PLC 75 may use the mass balance to monitor for instability of the lower formation 104*b*, such as formation fluid 106 entering the annulus 105 (FIG. 2B) and contaminating 61*r* the returns 60*r* or returns 60*r* entering the formation 104*b* (FIG. 2C).

Upon detection of instability, the PLC 75 may take remedial action, such as tightening the choke 36 (compare Back Pressure in FIG. 2A to same in FIG. 2B) in response to detection of formation fluid 106 entering the annulus 105 and relaxing the choke (compare Back Pressure in FIG. 2A to absence of same in FIG. 2C) in response to returns 60*r* entering the formation 104*b*. The PLC 75 may further divert the contaminated return mixture 61*m* into a degassing spool in response to detection of fluid ingress.

The degassing spool may include automated shutoff valves at each end, a mud-gas separator (MGS) 432 (FIG. 2B), and a gas detector. A first end of the degassing spool may be connected to the returns line 28 between the returns flow meter 34*r* and the shaker 33 and a second end of the degasser spool may be connected to an inlet of the shaker. The gas detector may include a probe having a membrane for sampling gas from the return mixture 60*m*, a gas chromatograph, and a carrier system for delivering the gas sample to the chromatograph. The MGS 432 may include an inlet and a liquid outlet assembled as part of the degassing spool and a gas outlet connected to a flare or a gas storage vessel.

Referring specifically to FIGS. 2C and 2D, relaxing of the choke 36 by the PLC 75 has instantaneously (i.e., less than or equal to twenty seconds) negotiated narrowing of the drilling window caused by the low pressure region 110*f* so that the drilling operation may continue without interruption. However, for the particular lower formation 104*b* shown, the actual BHP remains near the maximum threshold, leaving little or no margin. The PLC 75 may then reset the target BHP to be in a middle of the narrowed drilling window, and may increase a flow rate of the lifting pump 30*b* to achieve the target BHP. In contrast to the instantaneous response of operating the choke 36, the response of the actual BHP may be gradual (i.e., greater than or equal to twenty minutes). The gradual harmonization of the actual and target BHPs may be inconsequential as the drilling operation may be ongoing. The increase in the lifting fluid pump flow rate may be monotonic or gradual.

Alternatively, the PLC 75 may increase a flow rate of the lifting pump 30*b* while tightening the choke 36 in response to detection of fluid egress into the lower formation 104*b*. The flow rate increase may be monotonic or gradual and the choke tightening may be monotonic or gradual.

An analogous situation may occur for the fluid ingress scenario of FIG. 2B should the required tightening of the choke 36 create backpressure exceeding the design pressure of the RCD 43 (see FIG. 5 and discussion thereof below). In this instance, the PLC 75 may tighten the choke 36 to the RCD maximum pressure to instantaneously negotiate the high pressure region 110*p* while leaving little or no margin and then the PLC 75 may decrease the lifting pump flow rate to gradually improve the margin.

Alternatively, the PLC 75 may decrease a flow rate of the lifting pump 30*b* while relaxing the choke 36 in response to detection of fluid ingress to the annulus. The flow rate decrease may be monotonic or gradual and the choke relaxing may be monotonic or gradual. Alternatively, the riser 25 design pressure may be less than the RCD design pressure such that the riser is the weak point in the drilling system 1. Alternatively, the lower formation 104*b* may be drilled underbalanced and some ingress may be tolerated.

Alternatively, the PLC 75 may include other factors in the mass balance, such as displacement of the drill string 10 and/or cuttings removal. The PLC 75 may calculate a rate of penetration (ROP) of the drill bit 15 by being in communication with the drawworks 9 and/or from a pipe tally or a mass flow meter may be added to the cuttings chute of the shaker 33 and the PLC 75 may directly measure the cuttings mass rate. Additionally, the PLC 75 may monitor for other instability issues, such as differential sticking and/or collapse of the wellbore 100 by being in data communication with the top drive 5 for receiving torque exerted by the top drive and/or angular speed of the quill.

Should adjusting the choke 36 fail to restore pressure control of the wellbore, the PLC 75 may take emergency action, such as halting drilling (rotation of drill string, mud and lifting pumps), closing annular BOP 42*a*, and opening kill valve 45*a* in response to fluid ingress or halting drilling (rotation of drill string and mud pump), closing annular BOP, and maintaining or increasing pumping of the lifting fluid in response to fluid egress.

Figures 3A, 3B:
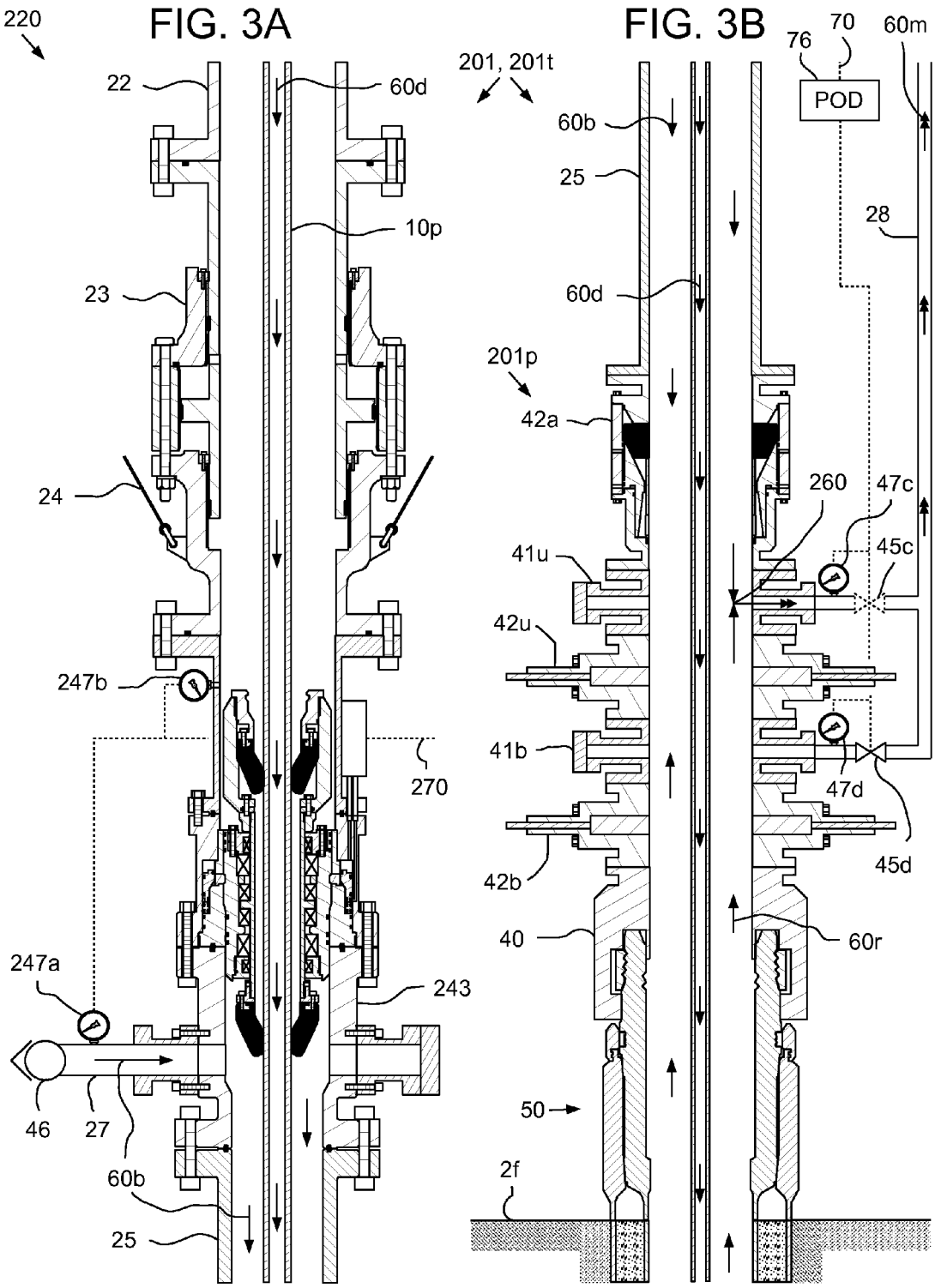
FIG. 3A illustrates a portion of an upper marine riser package (UMRP) of an offshore drilling system, according to another embodiment of the present invention.
FIG. 3B illustrates a pressure control assembly (PCA) of the drilling system.

FIG. 3A illustrates a portion of an UMRP 220 of an offshore drilling system 201, according to another embodiment of the present invention. FIG. 3B illustrates a PCA 201*p* of the drilling system 201. The drilling system 201 may include the MODU 1*m*, the drilling rig 1*r*, the fluid handling system 1*h*, a fluid transport system 201*t*, and a PCA 201*p*. The PCA 201*p* may be similar to the PCA 1*p* except that the RCD 43 and kill line 44 (and associated components) have been omitted. The fluid transport system 201*t* may be similar to the fluid transport system 1 except for the addition of an RCD 243 to the UMRP 220, connection of a lower end of the lift line 27 to an inlet of the RCD 243 instead of to the lower flow cross 41*b*, and the addition of one or more pressure sensors 247*a,b*.

The RCD 243 may be similar to the RCD 43 except for connection of the bearing assembly to the housing using a latch instead of a packing and orientation of both stripper seals to seal against the drill pipe 10*p* in response to higher pressure in the riser 25 than the UMRP 220 (components thereof above the RCD). The RCD housing may be connected to the upper end of the riser 25 and a lower end of the slip joint 23. The RCD housing may also be submerged adjacent the waterline 2*s*. The pressure sensor 247*a* may be connected to the lift line 27 between the check valve 46 and the RCD inlet and pressure sensor 247*b* may be connected to an upper housing section of the RCD 243 above the bearing assembly. The pressure sensors 247*a,b* may be in data communication with the PLC 75 and the RCD latch piston may be in fluid communication with the HPU of the PLC 75 via an interface of the RCD and RCD umbilical 270.

Alternatively, the RCD 243 may be located above the waterline 2*s* and/or along the UMRP 220 at any other location besides a lower end thereof. Alternatively, the RCD 243 may be located at an upper end of the UMRP 220 and the slip joint 23 and bracket connecting the UMRP to the rig may be omitted or the slip joint may be locked instead of being omitted.

The drilling operation conducted using the drilling system 201 may be similar to that conducted using the drilling system 1 except for the flow path of the lifting fluid 60*b*. The lifting fluid 60*b* may be injected into a top of the riser 25 via the RCD inlet and flow down the riser until the lifting fluid collides 260 with the returns 60*r* flowing upwardly from the wellbore 100, thereby forming the return mixture 60*m*. Should the lower formation 104*b* kick gas 106, the downward flow of the lifting fluid 60*b* may discourage the gas from separating from the contaminated returns 61*r* and floating up past the collision zone 260 into the riser 25 and instead encourage the gas to flow into the outlet of the upper flow cross 41*u* as part of the contaminated return mixture 61*m*.

Alternatively, the lifting fluid 60*b* may be injected into the PCA 201*p* and the return mixture 60*m* may flow up the riser 25 and be diverted from an outlet of the RCD 243. Additionally, for this alternative, the lift line 27 may be connected to the riser 25 at various points therealong for selective location of mixing (FIG. 5).

Figure 4A:
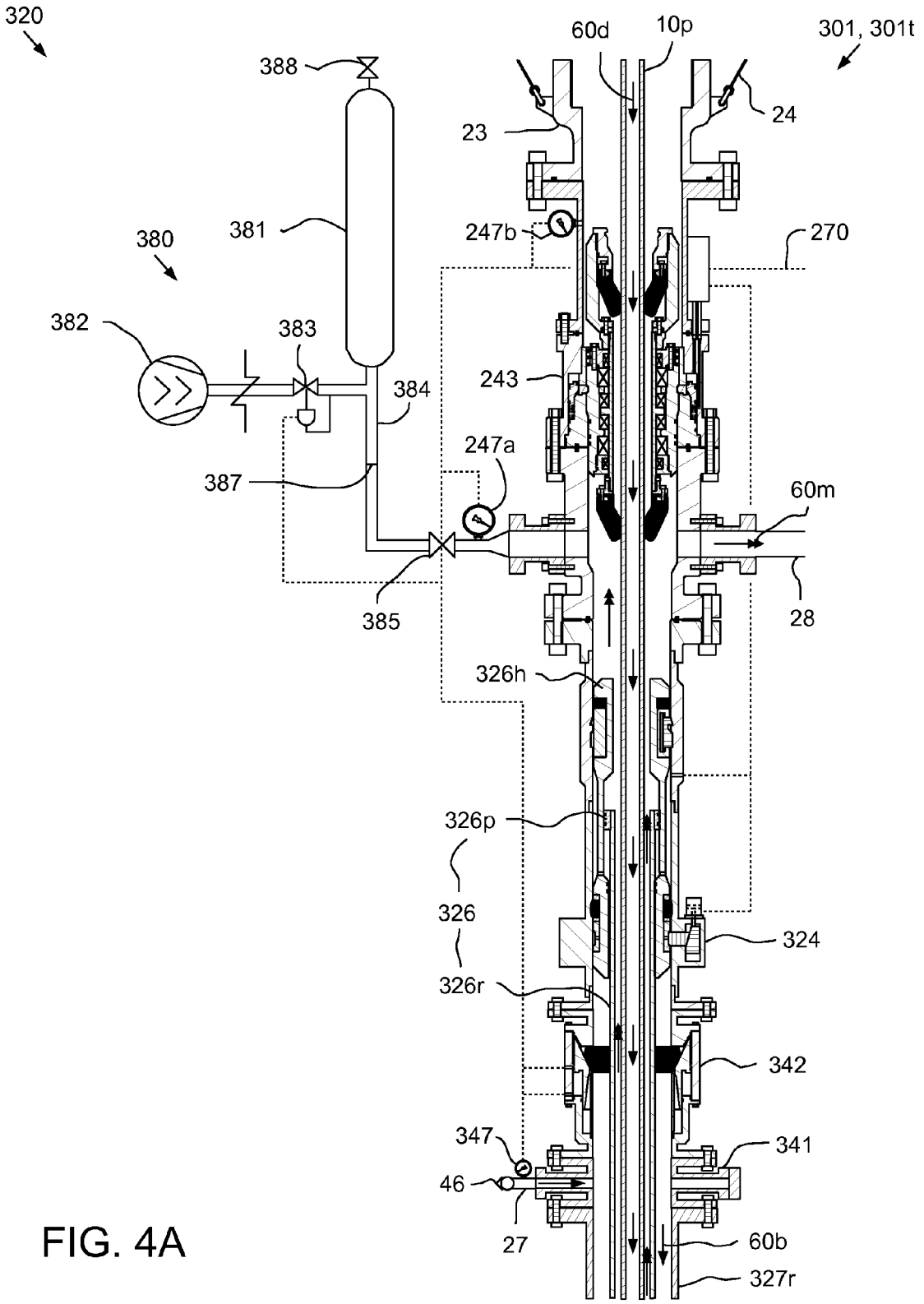
FIG. 4A illustrates a portion of an UMRP of an offshore drilling system, according to another embodiment of the present invention.
Figure 4B:
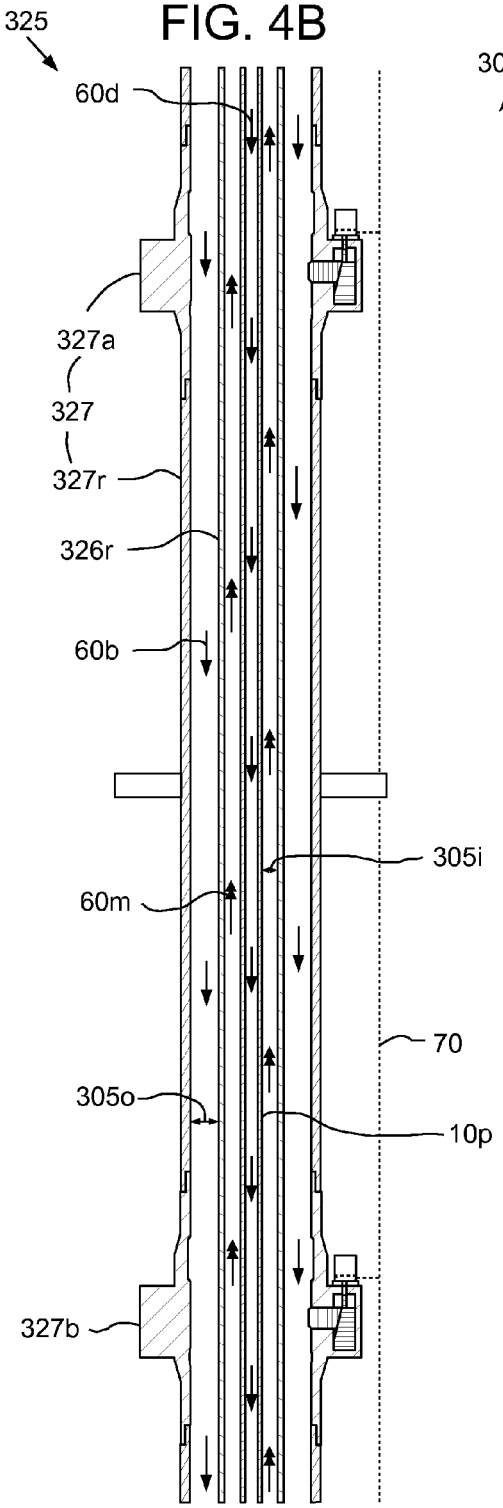
FIG. 4B illustrates a portion of a concentric marine riser of the drilling system.
Figure 4C:
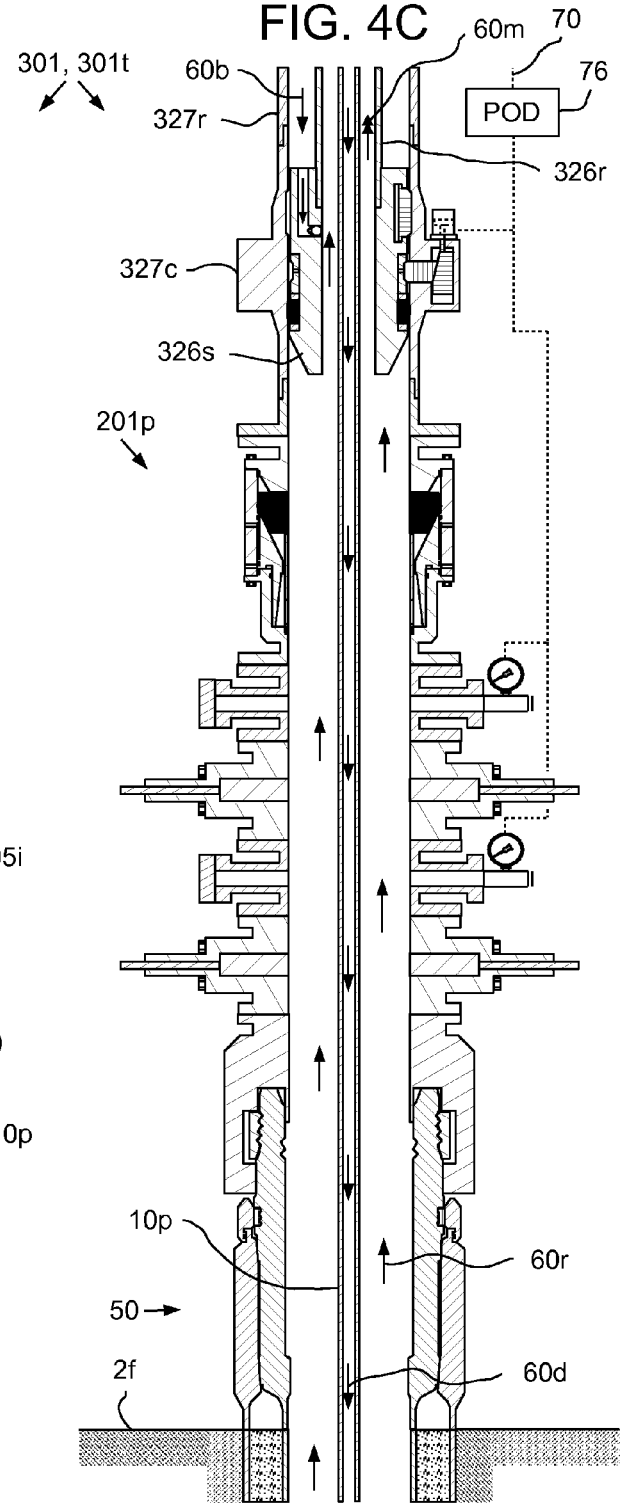
FIG. 4C illustrates connection of the concentric riser to the PCA.

FIG. 4A illustrates a portion of an UMRP 320 of an offshore drilling system 301, according to another embodiment of the present invention. FIG. 4B illustrates a portion of a concentric marine riser 325 of the drilling system 301. FIG. 4C illustrates connection of the concentric riser 325 to the PCA 201*p*.

The drilling system 301 may include the MODU 1*m*, the drilling rig 1*r*, the fluid handling system 1*h*, a fluid transport system 301*t*, and the PCA 201*p*. The fluid transport system 301*t* may include the drill string 10, the UMRP 320, the concentric riser 325, the lift line 27, and the return line 28. The UMRP 320 may include a diverter (not shown, see 21), a flex joint (not shown, see 22), the slip joint 23, the (outer) tensioner 24, the RCD 243, an inner tensioner 324, a seal head 342, a flow cross 341, and a riser compensator 380. The UMRP components may be connected together, such as by flanged connections.

The concentric riser 325 may include an inner riser string 326 concentrically disposed within an outer riser string 327 such that an outer annulus 305*o* is defined between the riser strings. The drill string 10 may extend through the inner riser string 326 such that an inner annulus 305*i* is defined between the drill string and the inner riser string. The inner riser string 326 may include a hanger 326*h*, a piston 326*p*, joints of riser pipe 326*r* connected together, such as by threaded connections, and a shoe 326*s*. The piston 326*p* and the shoe 326*s* may each be connected to a respective end of the inner riser pipe 326*r*, such as by a threaded connection. The outer riser string 327 may include end connectors, joints of riser pipe 327*r* connected together, such as by threaded connections, and one or more anchors 327*a-c*. Each end connector may be a flange connected to the respective end of the outer riser pipe, such as by a threaded connection. Each anchor 327*a-c* may be interconnected with the outer riser pipe 327*p*, such as by a threaded connection. The anchors 327*a-c* may be spaced along at least a portion of the outer riser string 327, such as along a mid and lower portion thereof (i.e., lower two-thirds).

The inner riser shoe 326*s* may include an annular body carrying one or more detents, such as drag blocks (only one shown), and a packer. The drag blocks may be spring-loaded and adapted to engage a detent profile, such as a groove, formed in an inner surface of each anchor 327*a-c*. Each anchor 327*a-c* may include a housing and a latch. The shoe packer may include an actuator ring disposed in a recess formed in an outer surface of the inner riser shoe. The actuator ring may be a two-part member having a groove formed in an outer surface thereof operable to receive one or more fasteners, such as dogs (only one shown), of each anchor latch. Engagement of the drag blocks with the respective anchor locator groove may occur when the actuator ring and the respective anchor latch dogs are aligned. Each anchor latch dog may be pushed into the actuator groove by a wedge of a respective anchor actuator. Each anchor actuator may further include a hydraulically operated piston and cylinder assembly. Each anchor wedge may be connected to a piston of the assembly by a rod. Engagement of the respective anchor dogs with the actuator ring may longitudinally connect the inner riser shoe 326*s* and the respective anchor 327*a-c*.

The riser shoe packer may further include a seal assembly having a packing straddled by backup rings and disposed in the shoe body recess. The seal assembly and actuator ring may interact such that when the respective anchor dogs are in a locking position with the shoe actuator ring groove, the shoe packing will be longitudinally compressed by action of the dogs driving the actuator ring members apart. Radial expansion of the shoe packing may result from compression thereof and the expanded packing may seal against an inner surface of a housing of the respective anchor 327*a-c*. Each anchor housing may have a shallow groove formed in an inner surface thereof for receiving the shoe packing.

The riser shoe body may further have a flow passage formed therethrough and a check valve. The shoe flow passage may provide fluid communication between the outer annulus 305*o* and the inner annulus 305*i*. The shoe check valve may be disposed in the passage and oriented to allow flow of the lifting fluid 60*b* through the passage from the outer annulus 305*o* to the inner annulus 305*i* and to prevent reverse flow of the returns 60*r* through the passage from the inner annulus to the outer annulus.

The hanger 326*h* may include an annular body having an upper portion carrying a first packer, a mid sleeve portion, and a lower portion carrying a second packer. The tensioner 324 may include a housing having an upper latch profile section, a mid sleeve section, and a lower latch section. The hanger second packer and the tensioner lower latch may include similar components and interact in a similar fashion to the riser shoe packer and the respective anchor latch. The hanger first packer may include one or more fasteners, such as keys (only one shown), and the tensioner latch profile may be a keyway operable to receive the keys. The hanger body may have a recess formed in an outer surface thereof and the keys may be spring-loaded into a key ring disposed in the recess. The hanger first packer may further include a packing disposed in the recess. Engagement of the keys and the keyways may longitudinally support the key ring from the tensioner such that continued longitudinal movement of the hanger relative to the tensioner may compress the hanger first packing into engagement with the upper tensioner housing section.

An outer hydraulic chamber may be formed between the hanger sleeve portion and the tensioner sleeve portion and isolated by the hanger packers. The tensioner sleeve portion may have a hydraulic port providing fluid communication between the outer chamber and the RCD umbilical 270. The hanger sleeve may have a hydraulic port providing fluid communication between the outer hydraulic chamber and a variable inner hydraulic chamber. The inner chamber may be formed between the inner riser pipe 326*r* and the hanger sleeve portion and isolated by the piston 326*p* and one or more seals carried by the hanger body lower portion. To account for changes in length of the inner riser 326 relative to the outer riser 327 due to variations in temperature, pressure, and/or loading, the inner riser may be tensioned by controlling the supply of hydraulic fluid to the hydraulic chambers. The hydraulic fluid may exert an upward force against the piston 326*p*, thereby tensioning the inner riser 326.

The riser compensator 380 may be employed to prevent fluid displacement caused by operation of the tensioner 324 from affecting the mixture flow meter 34*r*. The riser compensator 380 may include an accumulator 381, a gas source 382, a pressure regulator 383, a flow line 384, one or more shutoff valves 385, 388, and the pressure sensor 247*a*.

The shutoff valve 385 may be automated and have a hydraulic actuator (not shown) operable by the PLC 75 via fluid communication with the HPU. The shutoff valve 385 may be connected to a port of the RCD 243 and the flow line 384. The flow line 384 may be a flexible conduit, such as hose, and may also be connected to the accumulator 381 via a flow tee. The accumulator 381 may store only a volume of compressed gas, such as nitrogen. Alternatively, the accumulator may store both liquid and gas and may include a partition, such as a bladder or piston, for separating the liquid and gas. A liquid and gas interface 387 may be in the flow line 384. The shutoff valve 388 may be disposed in a vent line of the accumulator 381. The pressure regulator 383 may be connected to the flow line 384 via a branch of the tee. The pressure regulator 383 may be automated and have an adjuster operable by the PLC 75 via fluid communication with the HPU or electrical communication with the PLC. A set pressure of the regulator 383 may correspond to a set pressure of the choke 36 and both set pressures may be adjusted in tandem. The gas source 382 may also be connected to the pressure regulator 383.

The riser compensator 380 may be activated by opening the shutoff valve 385. During expansion of the inner riser 326, the volume of fluid displaced by the upward movement may flow through the shutoff valve 385 into the flow line 384, moving the liquid and gas interface 387 toward the accumulator 381 and accommodating the upward movement. The interface 387 may or may not move into the accumulator 381. During contraction of the inner riser 326, the interface 387 may move along the flow line 384 away from the accumulator 381, thereby replacing the volume of fluid moved thereby. Alternatively, the riser compensator may be omitted and the PLC 75 may adjust the measurement by the mixture flow meter 34*r* based on hydraulic fluid flow to the tensioner 324.

The lift line 27 may be connected to a branch of the flow cross 341. A pressure sensor 347 may be connected to the lift line 27 between the check valve 46 and the flow cross 341. The flow cross 341 may provide fluid communication between the lift line 27 and the outer annulus 305*o*. The pressure sensor 347 may be in data communication with the PLC 75. The flow cross 341 may be connected to the upper end connector of the outer riser 327. The seal head 342 may be connected to the flow cross 341. The seal head 342 may be an annular BOP including a housing, a packing, and a piston. The housing may have one or more hydraulic ports providing fluid communication between the PLC HPU and respective hydraulic chambers formed between the piston and the housing. The piston may be operated to longitudinally compress the packing into radial engagement against an outer surface of the inner riser pipe, thereby isolating a top of the outer annulus 305*o*.

The drilling operation conducted using the drilling system 301 may be similar to that conducted using the drilling system 1 except for the flow paths of the lifting fluid 60*b* and the return mixture 60*m*. The lifting fluid 60*b* may be injected into a top of the outer annulus 305*o* via the flow cross 341 and flow down the outer annulus. The lifting fluid 60*b* may continue into the inner riser shoe passage and through the check valve and may mix with the returns 60*r* at a bottom of the inner annulus 305*i*, thereby forming the return mixture 60*m*. The return mixture 60*m* may flow up the inner annulus 305*i* to the UMRP 320. The return mixture 60*m* may continue through the UMRP 320 until reaching the RCD 243. The RCD 243 may divert the return mixture 60*m* into an outlet thereof and into the return line 28 connected thereto.

FIG. 5 illustrates selection of a location of the inner riser shoe 326*s*. The lower formation 104*b* may have a narrow drilling window. Attempting to drill the lower formation 104*b* using the inner riser shoe 326*s* connected to the lower anchor 327*c* (illustrated by dashed line) would require backpressure exceeding the RCD design pressure (aka maximum). Connecting the inner riser shoe 326*s* to the upper anchor 327*a* reduces the required back pressure due to the increased hydrostatic pressure exerted by the increased length of the returns column (solid line) before density reduction by the lifting fluid 60*b*. The reduction in required backpressure allows for drilling of the lower formation 104*b* within the capability of the RCD 243. Shoe location selection and installation of the inner riser 326 may occur before commencement of the drilling operation.

Should the lower formation 104*b* kick gas 106, presence of the inner riser 326 in at least the upper portion of the outer riser 327 may serve to increase the pressure rating of the concentric riser 325 due to the reduced diameter of the inner riser. A wall thickness of the inner riser may also be increased relative to the outer riser. Further, the inner annulus 305*i* may also serve as a choked passage to limit the flow of gas therethrough.

Figure 6A:
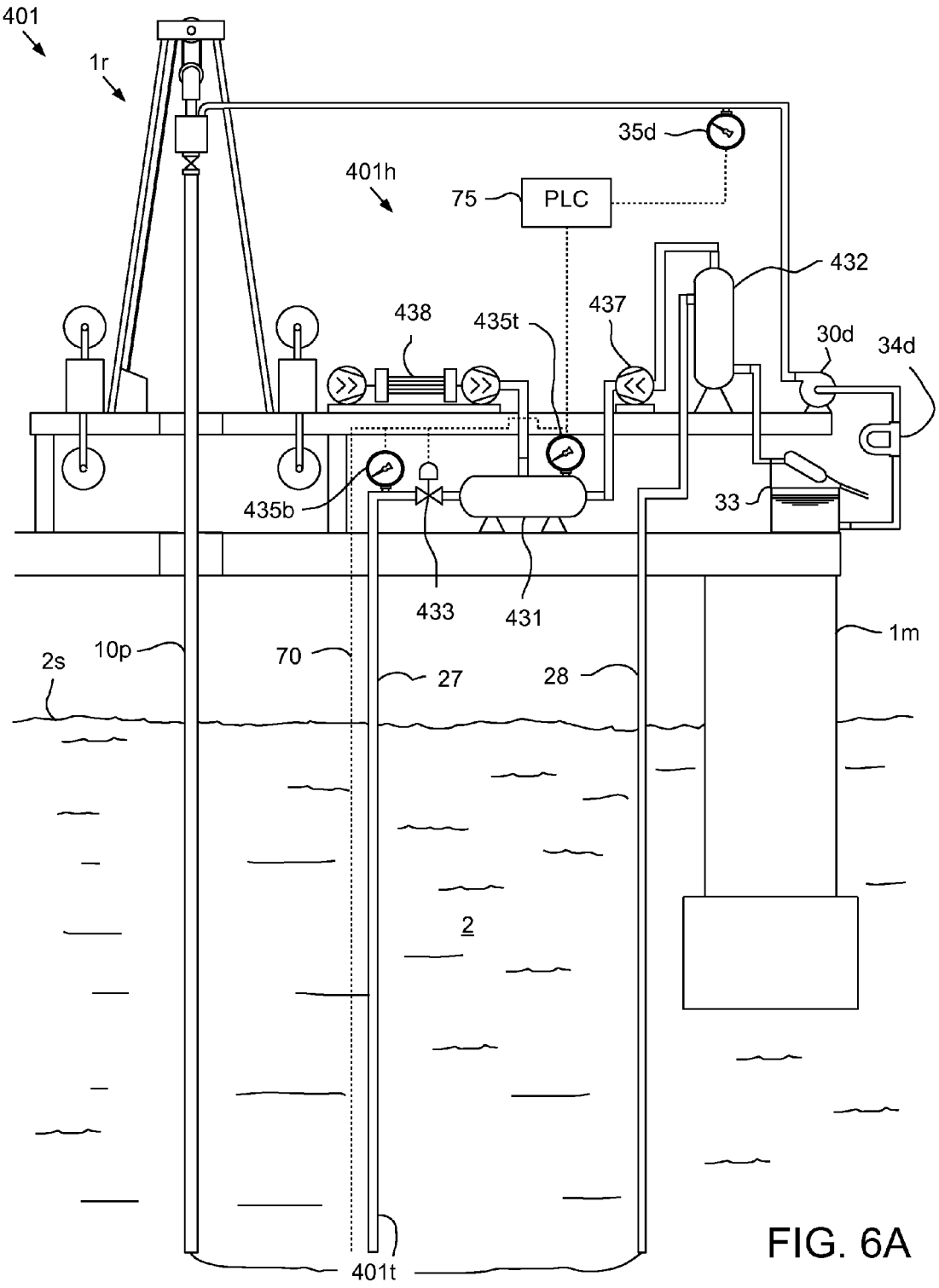
FIGS. 6A and 6B illustrate an offshore drilling system, according to another embodiment of the present invention.
Figure 6B:
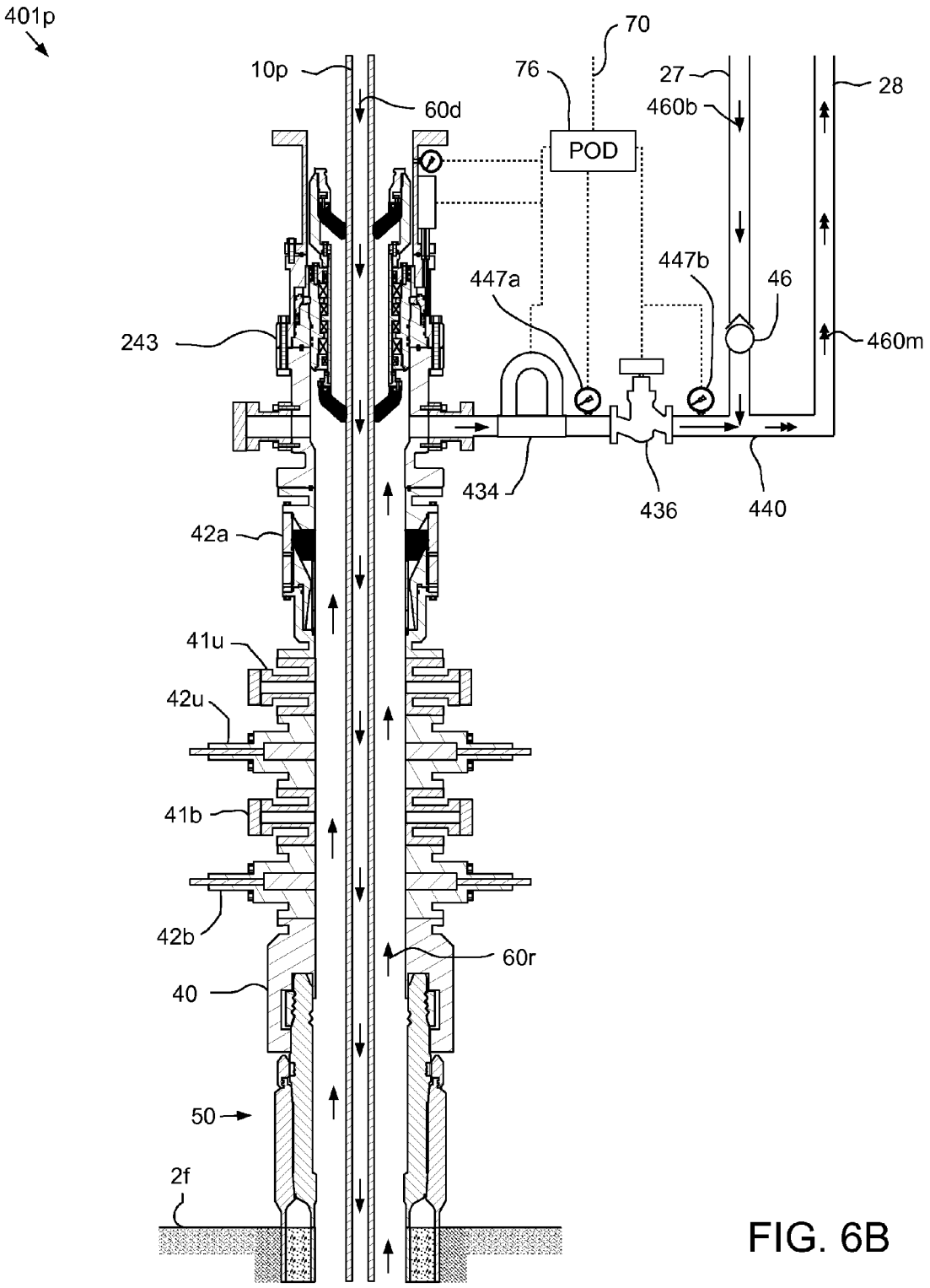

FIGS. 6A and 6B illustrate an offshore drilling system 401, according to another embodiment of the present invention. The drilling system 401 may include the MODU 1*m*, the drilling rig 1*r*, the fluid handling system 401*h*, a riserless fluid transport system 401*t*, and a riserless PCA 401*p*. The drilling system 401 may employ lifting fluid 460, such as a gas, (i.e., nitrogen) or gaseous mixture (i.e., mist or foam).

The fluid handling system 401*h* may include the mud pump 30*d*, a lift vessel 431, a fluid separator, such as a mud-gas separator 432, the shale shaker 33, the flow meter 34*d*, a flow control valve 433, one or more pressure sensors 35*d*, 435*b,t*, a transfer compressor 437, and a nitrogen production unit (NPU) 438. The NPU 438 may include an air compressor, a cooler, a demister, a heater, a particulate filter, a membrane, and a booster compressor. The air compressor may receive ambient air and discharge compressed air to the cooler. The cooler, demister, and heater may condition the air for treatment by the membrane. The membrane may include hollow fibers which allow oxygen and water vapor to permeate a wall of the fiber and conduct nitrogen through the fiber. An oxygen probe (not shown) may monitor and assure that the produced nitrogen meets a predetermined purity. The booster compressor may compress the nitrogen exiting the membrane for storage in the lift tank 431.

Each pressure sensor 35*d*, 435*b,t* may be in data communication with the PLC 75. The pressure sensor 435*t* may be connected to the lift tank 431. The PLC 75 may monitor the pressure in the lift tank 431 and activate the NPU 438 should the lift tank need charging. The pressure sensor 435*b* may be connected to the lift line 27 downstream of the flow control valve 433. The flow control valve 433 may be connected to an outlet of the lift tank 431 and the lift line 27 may be connected to the flow control valve. The lift line 27 may extend from the MODU 1*m* to a mixing manifold 440 of the PCA 401*p*. The PLC 75 may monitor and control the flow rate of lifting fluid 460*b* transported through the lift line 27 using the flow control valve 433. The flow control valve 433 may include an adjustable orifice or Venturi throat and an actuator for adjusting the orifice/throat. The actuator may be operated by the PLC 75 via hydraulic communication with the HPU. Alternatively, the actuator may be electric or pneumatic. The lift tank 431 may be maintained at a pressure sufficiently greater than a pressure of the mixing manifold 440 for sonic flow through the flow control valve 433. The PLC 75 may then calculate the mass flow rate of lifting fluid 460*b* using the orifice/throat area of the flow control valve 433.

The riserless fluid transport system 401*t* may include the drill string 10, the lift line 27, and the return line 28. The riserless PCA 401*p* may include the wellhead adapter 40, one or more flow crosses 41*u,b*, one or more blow out preventers (BOPs) 42*a,u,b*, the RCD 243, the control pod 76, one or more accumulators (not shown), a subsea flow meter 434, a subsea choke 436, and the mixing manifold 440. Alternatively, the RCD 43 may be used instead of the RCD 243.

The subsea flow meter 434, subsea choke 436, and pressure sensors 447*a,b* may be assembled as part of the mixing manifold 440. The subsea flow meter 434 may be a mass flow meter, such as a Coriolis flow meter, and may be in data communication with the PLC 75 via the pod 76 and the umbilical 70. The subsea flow meter 434 may be located in the mixing manifold 440 adjacent to the RCD outlet and may be operable to monitor a flow rate of the returns 60*r*. The subsea choke 436 may be located in the mixing manifold 440 between the subsea flow meter 434 and the lifting line 27. The subsea choke 436 may be fortified to operate in an environment where the returns 60*r* may include solids, such as cuttings. The subsea choke 436 may include a hydraulic actuator operated by the PLC HPU (via the pod 76 and the umbilical 70) to maintain backpressure in the wellhead 50.

Alternatively, a subsea volumetric flow meter may be used instead of the mass flow meter. Alternatively, the choke actuator may be electrical or pneumatic. Alternatively, the MODU choke 36 may be used instead of the subsea choke 436.

The mixing manifold 440 may be connected to the RCD outlet, the lift line 27, and the return line 28. The pressure sensors 447*a,b* may be located in the mixing manifold 440 in a position straddling the subsea choke 436. Each pressure sensor 447*a* may be in data communication with the PLC 75 via the pod 76 and the umbilical 70. The return line 28 may extend from the mixing manifold 440 to an inlet of the MGS 432 onboard the MODU 1*m*. The MGS 432 may be vertical, horizontal, or centrifugal and may be operable to separate the lifting fluid 460*b* from the return mixture 460*m*. The separated lifting fluid 460*b* may be supplied an inlet of the booster compressor 437. The booster compressor 437 may discharge the separated lifting fluid 460*b* to the lift vessel 431. Alternatively, the separated lifting fluid may be flared or vented to atmosphere. The separated returns 60*r* may be supplied to the shale shaker 33.

The drilling operation conducted using the drilling system 401 may be similar to that conducted using the drilling system 1 except for the gaseous lifting fluid 460*b*, the flow paths of the lifting fluid 460*b* and the return mixture 460*m*, and the mass balance monitoring by the PLC 75. The returns 60*r* may flow from the wellbore 100, through the wellhead 50 and into the PCA 401*p*. The returns 60*r* may continue through the PCA 401*p* and be diverted by the RCD 243 into an outlet thereof. The returns 60*r* may continue through the subsea mass flow meter 434 and the subsea choke 436 and into a mixing chamber of the manifold 440. Since the mass flow rate of the returns 60*r* may be measured upstream of mixing, the need for the lifting fluid flow rate for the PLC 75 to perform the mass balance may be obviated.

The lifting fluid 460*b* may be injected into lift line 27 from the lift vessel 431. The lifting fluid 460*b* may continue through the check valve 46 and may mix with the returns 60*r* in the mixing manifold 440, thereby forming the return mixture 460*m*. The return mixture 460*m* may flow up the return line 28 to the MGS 432 for recycling thereof.

Alternatively, the lift line 27 may be connected to the return line 28 at various points therealong for selective location of mixing (FIG. 5). Alternatively, a riser may be added to the drilling system 401 for barrier fluid (FIG. 1B). Alternatively, a riser may be added to the drilling system 401, the RCD 243 located in the UMRP, and the lifting fluid 460*b* injected down the riser instead of the lift line 27 for counter-flow mixing (FIG. 3B). In this counter-flow alternative, the mixture 460*m* would flow through the subsea flow meter 434 and choke 436 instead of the returns 60*r*. Alternatively, the lifting fluid 60*b* may be used with the drilling system 401 instead of the lifting fluid 460*b*.

Figure 6C:
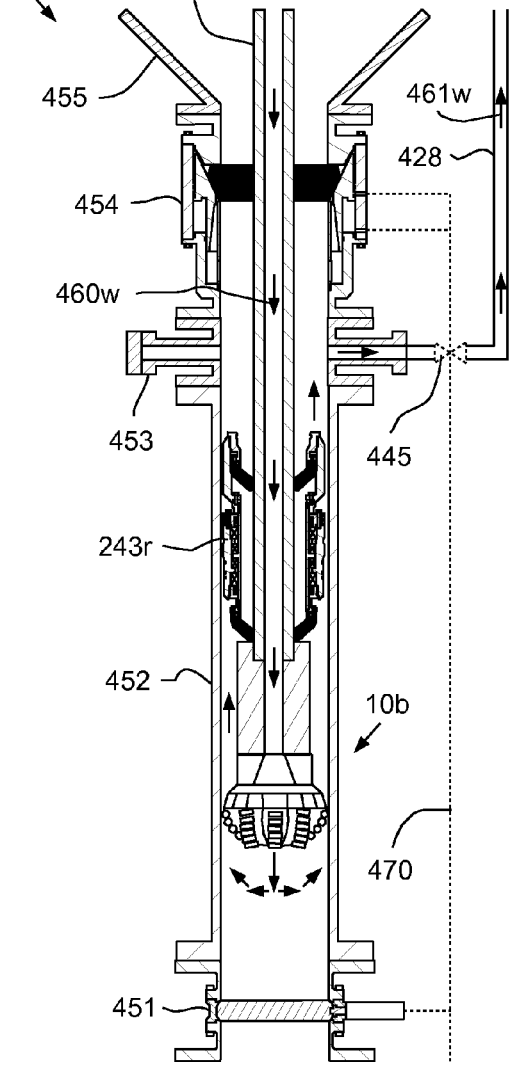
FIG. 6C illustrates a lubricator for use with the drilling system.

FIG. 6C illustrates a lubricator 450 for use with the drilling system 401. The PCA 401*p* may further include the lubricator 450 connected to a top of the RCD 243, such as by a flanged connection. The lubricator 450 may include a shutoff valve 451, a tool housing 452, a flow cross 453, a seal head 454, and a landing guide 455. The lubricator components 451-455 may each include a housing having a longitudinal bore therethrough and may each be connected, such as by flanges, such that a continuous bore is maintained therethrough. The bore may have drift diameter, corresponding to a drift diameter of the wellhead 50. The tool housing 452 may have a length corresponding to a combined length of the BHA 10*b* and the RCD bearing assembly 243*r*. The seal head 454 may be similar to the seal head 352. A branch of the flow cross 453 may be connected to a waste tank or waste treatment equipment (not shown) onboard the MODU 1*m* by a waste line 428. A shutoff valve 445 may be disposed in the waste line 428.

Each shutoff valve 445, 451 may be automated and have a hydraulic actuator operable by the control pod 76 via a jumper 470. Alternatively, the valve actuators may be electrical or pneumatic. The waste line valve 445 may be normally closed and the housing valve 451 may be normally open during the drilling operation. The seal head 454 may normally be disengaged from the drill pipe 10*p* during the drilling operation. The seal head piston may also be operated by the control pod 76 via the jumper 470.

The lubricator 450 may be used to wash the BHA 10*b* and the bearing assembly 243*r* during tripping of the drill string 10 to the MODU 1*m* after drilling the lower formation 104*b* has been completed or if maintenance of the BHA 10*b* or RCD 243 needs to be performed. The drill string 10 may be retrieved from the wellbore 100 until the BHA 10*b* reaches the PCA 401*p*. Once the BHA 10*b* is proximate to the RCD 243, the bearing assembly 243*r* may be released from the RCD housing. The BHA 10*b* may then carry the bearing assembly 243*r* as retrieval of the drill string 10 continues. Once the BHA 10*b* and bearing assembly 243*r* are located in the tool housing 452, the housing shutoff valve 451 may be closed, the seal head 454 engaged with the drill pipe 10*p*, and the waste line valve 445 opened.

Wash fluid 460*w* may be pumped down the drill string 10 and exit the drill bit 15. The wash fluid 460*w* may be environmentally compatible, such as seawater, hydrates inhibitor, or a mixture of the two. The wash fluid 460*w* may flush drilling fluid 60*d* from the drill string 10 and wash return residue from the BHA 10*b* and the bearing assembly 243*r*. The spent wash fluid 461*w* may be discharged from the tool housing 452 into the waste line 428 via the flow cross branch. The spent wash fluid 461*w* may continue to the MODU 1*m* via the waste line 428 for treatment or disposal. Once the washing operation is complete, the seal head 454 may be disengaged from the drill pipe 10*p* and the waste line valve 445 closed. Retrieval of the drill string 10 to the MODU 1*m* may then continue.

Alternatively, the housing shutoff valve 451 may be omitted and one of the BOPs 42*a,u,b* closed instead to wash the BHA.

Figure 6D:
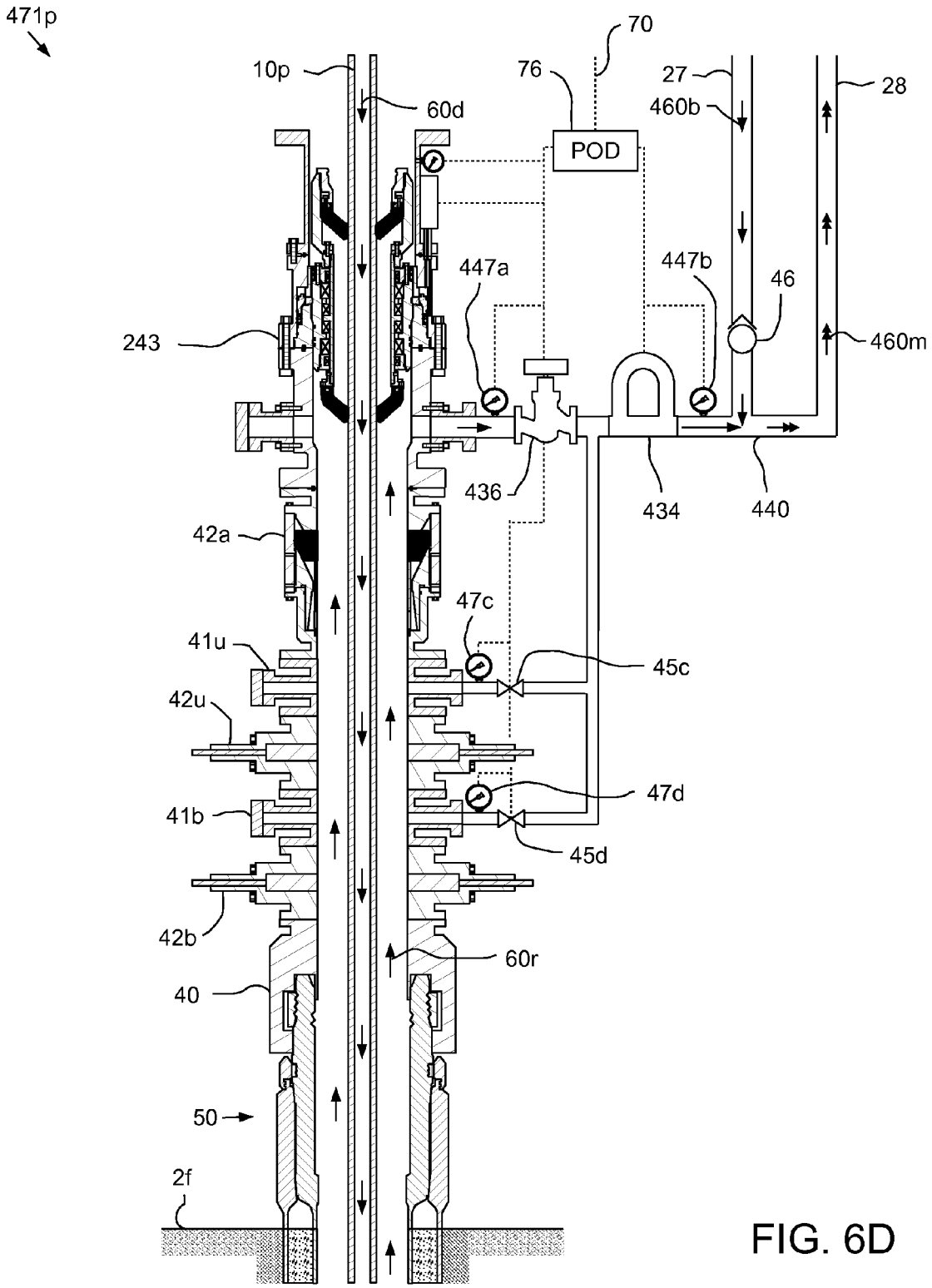
FIG. 6D illustrates an alternative PCA for use with the drilling system.

FIG. 6D illustrates an alternative PCA 471*p* for use with the drilling system 401. The PCA 471*p* may be similar to the PCA 401*p* except that the locations of the subsea choke 436 and subsea flow meter 434 in the mixing manifold 440 have been switched and a choke bypass line has been connected to the mixing manifold 447*a* and flow crosses 41*u,b*.

Figure 7A:
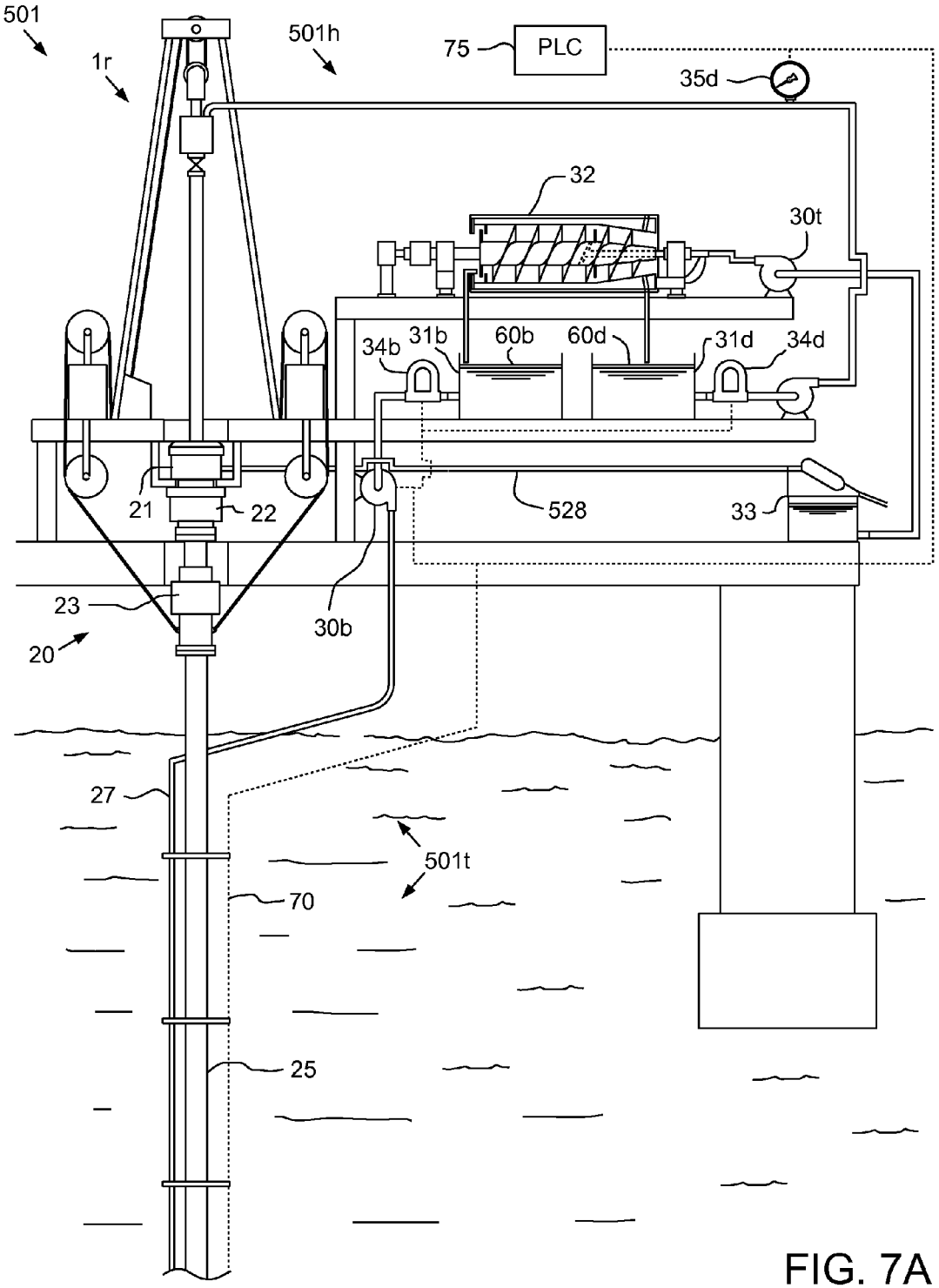

FIGS. 7A and 7B illustrate an offshore drilling system, according to another embodiment of the present invention. The drilling system 501 may include the MODU 1*m*, the drilling rig 1*r*, the fluid handling system 501*h*, a fluid transport system 501*t*, and a PCA 501*p*. The fluid handling system 501*h* may include the pumps 30*b,d,t*, the fluid tanks 31*b,d*, the centrifuge 32, the shale shaker 33, the pressure sensor 35*d*, and a return line 528. A first end of the return line 528 may be connected to an outlet of the diverter 21 and a second end of the return line 528 may be connected to an inlet of the shaker 33.

The PCA 501*p* may include the wellhead adapter 40, the flow crosses 41*u,b*, a flow cross 541, the BOPs 42*a,u,b*, the RCD 243, the control pod 76, the accumulators, the LMRP, a subsea flow meter 434, a subsea choke 436, a bypass spool 540, and the receiver 546. Alternatively, the RCD 43 may be used instead of the RCD 243. The fluid transport system 501*t* may include the drill string 10, the UMRP 20, the marine riser 25, and the lift line 27.

The flow cross 541 may be connected to the receiver 546 and to an upper end of the RCD 243. The bypass line 540 may be connected to the RCD outlet and a branch of the flow cross 541. A lower end of the lift line 27 may also be connected to a branch of the flow cross 541. The pressure sensors 447*a,b* may be located in the bypass line 540 in a position straddling the subsea choke 436. Each pressure sensor 447*a* may be in data communication with the PLC 75 via the pod 76 and the umbilical 70. The subsea flow meter 434 subsea choke 436, and pressure sensors 447*a,b* may be assembled as part of the bypass line 540. The subsea flow meter 434 may be located in the bypass line 540 adjacent to the RCD outlet and may be operable to monitor a flow rate of the returns 60*r*. The subsea choke 436 may be located in the bypass line downstream of the flow meter 434.

Alternatively, the locations of the flow meter 434 and choke 436 in the bypass spool 540 may be switched. Alternatively, a subsea volumetric flow meter may be used instead of the mass flow meter. Alternatively, the choke actuator may be electrical or pneumatic. Alternatively, the MODU choke 36 may be used instead of the subsea choke 436.

The drilling operation conducted using the drilling system 501 may be similar to that conducted using the drilling system 1 except for the flow paths of the lifting fluid 60*b* and the return mixture 60*m* and the mass balance monitoring by the PLC 75. The returns 60*r* may flow from the wellbore 100, through the wellhead 50 and into the PCA 501*p*. The returns 60*r* may continue through the PCA 501*p* and be diverted by the RCD 243 into the bypass line 540. The returns 60*r* may continue through the subsea mass flow meter 434 and the subsea choke 436 and exit the bypass line into an upper portion of the PCA 501*p*. Since the mass flow rate of the returns 60*r* may be measured upstream of mixing, the need for the lifting fluid flow rate for the PLC 75 to perform the mass balance may be obviated.

The lifting fluid 60*b* may be injected into the lift line 27 by the lift pump 30*b*. The lifting fluid 60*b* may continue through the check valve 46 and may mix with the returns 60*r* in the PCA upper portion, thereby forming the return mixture 60*m*. The return mixture 60*m* may flow up the riser 25 to the diverter 21. The return mixture 60*m* may flow into the return line 528 via the diverter outlet. The returns may continue through to the shale shaker 33 and be processed thereby to remove the cuttings.

Alternatively, the lift line 27 may be connected to the riser 25 at various points therealong for selective location of mixing (FIG. 5). Alternatively, the mixing manifold 440 and return line 28 may be used instead of the return line 528 and the bypass spool 540 and the riser 25 used for barrier fluid (FIG. 1B) or omitted. Alternatively, the RCD 243 may be located in the UMRP and the lifting fluid 60*b* injected down the riser 25 instead of the lift line 27 for counter-flow mixing (FIG. 3B). In this counter-flow alternative, the mixture 60*m* would flow through the subsea flow meter 434 and choke 436 instead of the returns 60*r*.

Alternatively, the subsea flow meter 434 and/or subsea choke 436 may be used in any of the other drilling systems 1, 201, 301 instead of the respective MODU flow meter 34*r* and/or MODU choke 36. Alternatively, the gaseous lifting fluid 460*b* may be used in any of the other drilling systems 1, 201, 301, 501 instead of the lifting fluid 60*b*.

While the foregoing is directed to embodiments of the present invention, other and further embodiments of the invention may be devised without departing from the basic scope thereof, and the scope thereof is determined by the claims that follow.

The invention claimed is:

1. A method of drilling a subsea wellbore, comprising:

drilling the wellbore by injecting drilling fluid through a tubular string extending into the wellbore from an offshore drilling unit (ODU) and rotating a drill bit disposed on a bottom of the tubular string, wherein:

the drilling fluid exits the drill bit and carries cuttings from the drill bit, and the drilling fluid and cuttings (returns) flow to a floor of the sea via an annulus defined by an outer surface of the tubular string and an inner surface of the wellbore, and while drilling the wellbore:

mixing lifting fluid with the returns at a flow rate proportionate to a flow rate of the drilling fluid, thereby forming a return mixture, wherein:

the lifting fluid has a density substantially less than a density of the drilling fluid, and the return mixture has a density substantially less than the drilling fluid density;

measuring a flow rate of the returns or the return mixture;

comparing the measured flow rate to the drilling fluid flow rate to ensure control of a formation being drilled; and adjusting the lifting fluid flow rate in response to the comparison.

2. The method of claim 1, wherein the returns flow from the seafloor, through a subsea wellhead, and into a pressure control assembly (PCA) connected to the subsea wellhead.

3. The method of claim 2, wherein:
the lifting fluid is mixed with the returns in the PCA, and
the return mixture flows from the PCA to the ODU via a conduit.

4. The method of claim 3, wherein the lifting fluid is injected into the PCA through a first auxiliary line.

5. The method of claim 4, wherein the conduit is a second auxiliary line.

6. The method of claim 4, wherein the conduit is a marine riser.

7. The method of claim 2, wherein:
a marine riser is connected to the PCA and connected to the ODU by an upper marine riser package (UMRP),
the lifting fluid is mixed with the returns by injection into the UMRP and down the marine riser, and
the return mixture flows to the ODU via a conduit.

8. The method of claim 7, wherein the conduit is an auxiliary line.

9. The method of claim 7, wherein:
the marine riser is an outer riser,
an inner riser is disposed in the outer riser and extends from the UMRP toward the PCA along at least a portion of the outer riser,
the lifting fluid is transported down an outer annulus formed between the risers,
the lifting fluid is mixed with the returns at a shoe of the inner riser, and
the conduit is an inner annulus formed between the inner riser and the tubular string.

10. The method of claim 9, further comprising selectively locating the inner riser shoe along the outer riser.

11. The method of claim 2, wherein:
the lifting fluid is mixed with the returns in a conduit extending from the PCA to the ODU, and
the lifting fluid is injected into the conduit through an auxiliary line.

12. The method of claim 11, further comprising selectively locating an injection point of the lifting fluid along the conduit.

13. The method of claim 1, wherein the flow rate is measured using a subsea mass flow meter.

14. The method of claim 1, wherein:
the measured flow rate is the return mixture flow rate,
the flow rate is measured using a mass flow meter located onboard the ODU, and
the lifting fluid flow rate is included in the comparison.

15. The method of claim 1, wherein the measured flow rate is the returns flow rate.

16. The method of claim 1, wherein:
the returns or the return mixture flows through a variable choke valve, and
the method further comprises adjusting the variable choke valve in response to the comparison.

17. The method of claim 16, wherein:
the return mixture flows through the variable choke valve, and
the variable choke valve is located onboard the ODU.

18. The method of claim 16, wherein the variable choke valve is located subsea.

19. The method of claim 18, wherein the returns flow through the subsea variable choke valve.

20. The method of claim 18, wherein the return mixture flows through the subsea variable choke valve.

21. The method of claim 1, wherein:
drilling fluid is mud, and
the lifting fluid is base liquid of the mud.

22. The method of claim 21, wherein:
the mud is oil based, and
the method further comprises separating the return mixture into the mud and base oil and recycling the separated mud and base oil while drilling the wellbore.

23. The method of claim 1, wherein:
the lifting fluid density is less than a density of seawater, and
the return mixture density corresponds to the seawater density.

24. The method of claim 1, wherein the return mixture density is one-half to three-fourths of the drilling fluid density.

25. The method of claim 1, wherein the lifting fluid is gaseous.

26. A method of drilling a subsea wellbore, comprising:
drilling the wellbore by injecting drilling fluid through a tubular string extending into the wellbore from an offshore drilling unit (ODU) and rotating a drill bit disposed on a bottom of the tubular string,
wherein:
the drilling fluid exits the drill bit and carries cuttings from the drill bit, and
the drilling fluid and cuttings (returns) flow to a floor of the sea via an annulus defined by an outer surface of the tubular string and an inner surface of the wellbore, and
while drilling the wellbore:
mixing lifting fluid with the returns at a flow rate proportionate to a flow rate of the drilling fluid, thereby forming a return mixture,
wherein:
the lifting fluid has a density substantially less than a density of the drilling fluid,
the return mixture has a density substantially less than the drilling fluid density,
the returns flow from the seafloor, through a subsea wellhead, and into a pressure control assembly (PCA) connected to the subsea wellhead,
a marine riser is connected to the PCA and connected to the ODU by an upper marine riser package (UMRP),
the lifting fluid is mixed with the returns by injection into the UMRP and down an annulus formed between the tubular string and the marine riser, and
the return mixture flows to the ODU via an auxiliary line extending along an outer surface of the marine riser;
measuring a flow rate of the returns or the return mixture; and
comparing the measured flow rate to the drilling fluid flow rate to ensure control of a formation being drilled.

* * * * *